US006435643B1

(12) United States Patent
Miura et al.

(10) Patent No.: US 6,435,643 B1
(45) Date of Patent: Aug. 20, 2002

(54) IMAGE PRINTING APPARATUS AND IMAGE PRINTING METHOD

(75) Inventors: Yasushi Miura; Yoshiko Miyashita; Shizuko Fukuda, all of Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/219,893

(22) Filed: Dec. 24, 1998

(30) Foreign Application Priority Data

Dec. 26, 1997 (JP) ..... 9-361581

(51) Int. Cl.[7] ..... B41J 29/393
(52) U.S. Cl. ..... 347/19
(58) Field of Search ..... 347/19, 37, 15, 347/43, 105

(56) References Cited

U.S. PATENT DOCUMENTS

| | | | | | |
|---|---|---|---|---|---|
| 4,313,124 | A | | 1/1982 | Hara | 346/140 |
| 4,345,262 | A | | 8/1982 | Shirato et al. | 346/140 |
| 4,459,600 | A | | 7/1984 | Sato et al. | 346/140 |
| 4,463,359 | A | | 7/1984 | Ayata et al. | 346/1.1 |
| 4,558,333 | A | | 12/1985 | Sugitani et al. | 346/140 |
| 4,608,577 | A | | 8/1986 | Hori | 346/140 |
| 4,723,129 | A | | 2/1988 | Endo et al. | 346/1.1 |
| 4,740,796 | A | | 4/1988 | Endo et al. | 346/1.1 |
| 5,189,521 | A | * | 2/1993 | Ohtsubo et al. | 347/19 |
| 5,353,052 | A | | 10/1994 | Suzuki et al. | 347/19 |
| 5,530,460 | A | * | 6/1996 | Wehl | 347/19 |
| 6,020,976 | A | * | 2/2000 | Fujita et al. | 358/1.3 |
| 6,024,431 | A | * | 2/2000 | Takahashi et al. | 347/19 |
| 6,039,427 | A | * | 3/2000 | Kanome | 347/19 |

FOREIGN PATENT DOCUMENTS

| | | | |
|---|---|---|---|
| EP | 0 452 157 | 10/1991 | 347/19 |
| EP | 0 517 544 | 12/1992 | |
| EP | 0 869 007 | 10/1998 | 347/19 |
| JP | 54-56847 | 4/1979 | |
| JP | 59-123670 | 7/1984 | |
| JP | 59-138461 | 8/1984 | |
| JP | 60-71260 | 4/1985 | |
| JP | 62-53492 | 3/1987 | |
| JP | 2-172755 | 7/1990 | 347/19 |
| JP | 3-46589 | 2/1991 | |
| JP | 7-326313 | 12/1995 | |

* cited by examiner

*Primary Examiner*—John Barlow
*Assistant Examiner*—Julian D. Huffman
(74) *Attorney, Agent, or Firm*—Fitzpatrick, Cella, Harper & Scinto

(57) ABSTRACT

A density difference correction signal is generated for correcting a density difference upon forward path printing and backward path printing by density difference correction signal generating apparatus to store the generated density difference correction signal in an unevenness correction RAM. A predetermined correction line in a HS table memory is selected depending upon the density difference correction signal. By the selected correction line, the density correction of the image data of forward path printing and backward path printing is performed to output the image data.

22 Claims, 27 Drawing Sheets

| PALLET DATA | CYAN | MAGENTA | YELLOW | BLACK | S1 | .... | S4 |
|---|---|---|---|---|---|---|---|
| 0 | 10 | 10 | 10 | 0 | 0 | .... | 0 |
| 1 | 0 | 0 | 0 | 0 | 255 | .... | 0 |
| 2 | 0 | 0 | 0 | 0 | 0 | .... | 255 |
| 3 | 150 | 150 | 0 | 0 | 0 | .... | 0 |
| 4 | 0 | 0 | 0 | 255 | 0 | .... | 0 |
| 5 | 0 | 200 | 200 | 0 | 0 | .... | 0 |
| 6 | 0 | 250 | 100 | 0 | 0 | .... | 0 |
| | | | | | | .... | |
| | | | | | | .... | |
| 254 | 0 | 0 | 255 | 0 | 0 | .... | 0 |
| 255 | 0 | 0 | 0255 | 0 | 0 | .... | 0 |

*FIG.24*

IMAGE PRINTING APPARATUS AND IMAGE PRINTING METHOD

This application is based on Patent Application No. 361,581/1997 filed on Dec. 26, 1997 in Japan, the content of which is incorporated hereinto by reference.

BACKGROUND OF THE INVENTION

1. Field of the Invention

The present invention relates generally to an image printing apparatus and a method, such as an ink-jet printing system or the like. More particularly, the invention relates to an image printing apparatus and a method performing a density correction for an image data upon forward printing and backward printing.

2. Description of the Related Art

A typical method for performing printing for cloth, wall paper and so on, is a screen cloth printing method for directly printing on a cloth or the like using a silk screen printing plate. In performing this method, each silk screen printing plate for each color used in an original image to be printed in a screen cloth printing apparatus is installed so that an ink of the corresponding color is directly transferred to the cloth or the like through mesh of the silk screen printing plate.

However, in such a screen cloth printing method, printing plates corresponding to ink colors are required to be prepared. Therefore, a large amount of process steps are required for preliminarily preparing the silk screen printing plate and many days are taken for completing the printing products. In addition, there are operations to blend inks for each color and registration adjustment of the silk screen printing plates for respective colors and so on are required. Furthermore, the screen cloth printing apparatus is bulky and becomes more bulky in proportion to the increase of number of colors to be used and therefore requires a large installation space. In addition, storage space of the silk screen printing plates is also required.

Therefore, there has been proposed a printing method of an ink-jet printing system for directly printing an image on a printing medium, such as a cloth, a wall paper and so on. The printing method in the ink-jet system is a method for printing the image on the printing medium by ejecting fine ink droplets toward the printing medium, such as cloth or the like from ejection openings (nozzles) provided in a printing head for ink-jet printing. With such printing method, screen printing plates required for the conventional screen cloth printing becomes unnecessary. As a result, process steps and days for forming the image on the cloth or the like can be significantly reduced. Also, down-sizing of the apparatus also becomes possible. Furthermore, an image information for printing can be stored in storage medium, such as tape, flexible disk, an optical disk or the like to exhibit superior storage ability of the image information. In addition, variation of color scheme, modification of layout, increasing and decreasing of magnification and so on for a current image can be performed easily.

Upon performing cloth printing by the ink-jet printing system, the cloth dyed object can be a natural fiber, such as cotton, silk, wool and the like, synthetic fiber, such as nylon, rayon, polyester and the like, mixed fiber spinning of those fibers. Accordingly, coloring agents for coloring these fibers are also in wide variety. For example, water insoluble dye or a dye having low solubility in water can be used, such as a dispersion dye for polyester fiber, a metal complex dye for wool, a vat dye or pigment for cotton. In order to prepare a water based ink from insoluble or low solubility coloring agent, fine particulate of chromogen is formed and dispersed in water by a dispersion agent to form emulsion.

Among the foregoing ink-jet type printing apparatus, in a serial type printing apparatus employing a serial scanning type taking a direction intersecting a transporting direction of the printing medium (auxiliary scanning direction) as a primary scanning direction, an image is printed by nozzles of the printing head mounted on a carriage moving in the primary scanning direction along the printing medium. After printing (forward printing) for one line, paper feeding (pitch feeding) for a predetermined amount is performed in the auxiliary scanning direction. Then, printing for the next line is performed in batch process (backward printing). By repeating these operations, printing on the entire printing medium can be performed. Printing can be further sped up by using an ink-jet type printing apparatus having a serial type printing head, in which a large number of ejection openings are arranged along the width direction of the printing medium.

Using such ink-jet type printing apparatus for cloth printing, the screen printing plate used for screen cloth printing becomes unnecessary to reduce process steps and days to print the cloth for down-sizing the apparatus.

However, in the ink-jet printing apparatus, a gap between the cloth and the printing head becomes greater in comparison with the normal printer for computer. In the cloth printing, since there are clothes of various textures, the large gap between the cloth and the printing is inherent.

Therefore, the peculiar problem for an on-demand type ink-jet printing apparatus may occur. That is to say, by a subsidiary liquid droplet generated upon primary droplet ejection, a difference in densities may occur between forward scanning printing and backward scanning printing in the primary scan of the printing head. This difference of density is regarded as one factor of degradation of the image quality.

This will be further explained hereinafter with reference to special example.

FIGS. 25A to 25G generally show liquid ejection process in a bubble jet type ink-jet printing. Hereinafter, respective steps in FIGS. 25A to 25G of the printing process will be explained in sequential order.

FIG. 25A shows a condition where an ink 1510 is filled within a nozzle 1500.

As shown in FIG. 25B, by applying an energy to an electrothermal transducer 1520 for a quite short period, the ink in the vicinity of the electrothermal transducer 1520 is abruptly heated to generate a fine bubble 1530.

As shown in FIG. 25C, the ink 1510 is evaporated abruptly to cause growth of the fine bubble 1530.

Then, as shown in FIG. 25D, due to expansion of the bubble 1530 maximum, the ink 1510 is pushed out.

As shown in FIG. 2E, the bubble 1530 is abruptly shrunk as being cooled by the ink 1510. Then, the pushed out ink becomes an ink droplet 1540 in a form of droplet.

As shown in FIG. 2F, the ink droplet 1540 is pushed out to fly in the direction of arrow.

As shown in FIG. 2G, the tail portion of the ink droplet 1540 becomes droplet form by surface tension.

Not limited to the bubble-jet printing, upon ejection of liquid droplet in an ink-jet printing in broader sense, the tail portion upon primary droplet ejection becomes an ink droplet 15 by surface tension of the ink per se, in addition to the primary droplet (ink droplet 1540) originally required for printing, subsidiary ink droplet (hereinafter referred to as satellite) is generated. Since the satellite is formed by shred of the tail portion extending from the primary droplet, it has been observed that flying speed thereof is lower than that of the primary droplet.

In serial scan printing, as long as performing printing in one path, either in forward side or backward side, the generated satellite constantly deposited in the same direction on the cloth to cause no problem in image designing. However, it is typical to perform reciprocal printing in order to achieve improvement of printing speed. Then, problem can be encountered by satellite.

On the other hand, it has been clear from observation that satellite flies with "an angle offset from the primary droplet". FIG. 26 shows comparison of the ejecting angle of the primary droplet and satellite. Assuming that a speed of a carriage mounting a printing head having the nozzles for ink ejection is V, the primary droplet ejected from the nozzle flies at the primary droplet speed V with the ejecting angle $\theta$. In contrast to this, the satellite flies at a satellite speed $V_S$ with ejecting angle $\theta_s$. Here, "an angle offset from the primary droplet" set forth above, is an angle $\theta_a$ expressed by $\theta_a=\theta-\theta_S$ in FIG. 26.

FIGS. 27A and 27B a show dot deposited on the cloth by the primary droplet and satellite.

FIG. 27A shows the dot formed by printing in the forward scan. On the other hand, FIG. 27B shows the dot formed by printing in the backward scan. The flying angle of the satellite 1550 is offset in the extent of 1° angle relative that of the primary droplet 1560 and flying speeds are different. Therefore, while the flying speed of the satellite 1550 generated in the forward scan is lower than that of the primary droplet 1560, the dot formed by satellite 1550 is hidden in the dot formed by the primary droplet 1560 as shown in FIG. 27A. In contrast to this, the satellite 1550 generated in the backward scan deposits at different position to the deposit position of the primary droplet 1560 as shown in FIG. 27B.

As set forth above, in the forward scan, since satellite 1550 deposit within the dot formed by the primary droplet 1560, colored area is held unchanged. However, in the backward scan, since the primary droplet 1560 and the satellite 1550 deposit at different positions, the colored area becomes primary droplet+satellite. Density in the ink-jet type printing is determined by colored area on the cloth namely, when ink deposition area is larger, density becomes higher correspondingly. Therefore, difference of the colored area in the forward scan and the backward scan should be perceived as difference of density.

As can be appreciated from the foregoing example, since a difference in densities between the forward scan and the backward scan becomes perceptible in the primary scan of the printing head, degradation of the image on the printing medium, such as cloth or the like, can be caused to make it difficult to perform high quality printing.

SUMMARY OF THE INVENTION

Therefore, it is an object of the present invention to provide a printing apparatus and a method which can eliminate difference between an image density upon forward scan and an image density upon backward scan, and can perform high quality image printing with avoiding influence of satellite.

In a first aspect of the present invention, there is provided an image printing apparatus performing printing of an image for a printing medium by reciprocating a printing head, comprising:

density difference correction signal generating means for generating a density difference correction signal for correcting a density difference between an image density upon forward path printing by the printing head and an image density upon backward path printing by the printing head;

storage means for storing the generated density difference correction signal; and density conversion means for varying image density of image data for forward printing and backward printing depending upon stored density difference correction signal.

In a second aspect of the present invention, there is provided an image printing apparatus reciprocating a plurality of printing heads and performing overlay printing of an image for a printing medium by the combined scans of forward path and backward path of a plurality of the printing heads, comprising:

density difference correction signal generating means for generating a density difference correction signal for correcting a density difference by the combined scans of forward path and backward path of a plurality of the printing heads;

storage means for storing the generated density difference correction signal; and density conversion means for varying image density of image data upon printing by the combined scans of the forward path and the backward path depending upon the stored density difference correction signal.

In a third aspect of the present invention, there is provided an image printing apparatus reciprocating a printing head to perform performing printing of an image for a printing medium, comprising:

printing means for printing test images in forward path scan and backward path scan of the printing head;

reading means for reading the printed test images;

density difference correction signal generating means for generating a density difference correction signal for correcting a density difference between the test image density upon forward path printing by the printing head and the test image density upon backward path printing by the printing head;

storage means for storing the generated density difference correction signal; and density conversion means for varying image density of image data for forward printing and backward printing depending upon stored density difference correction signal.

In a fourth aspect of the present invention, there is provided an image printing apparatus reciprocating a plurality of printing heads and performing overlay printing of an image for a printing medium by the combined scans of forward path and backward path of a plurality of the printing heads, comprising:

printing means for printing test images by the combined scans of forward path and backward path scan of the printing heads;

reading means for reading the printed test images;

density difference correction signal generating means for generating a density difference correction signal for correcting a density difference of the test images formed by the combined scans of forward path and backward path of a plurality of the printing heads;

storage means for storing the generated density difference correction signal; and density conversion means for varying image density of image data upon printing by the combined scans of the forward path and the backward path depending upon the stored density difference correction signal.

In a fifth aspect of the present invention, there is provided an image printing method performing printing of an image for a printing medium by reciprocating a printing head, comprising the steps of:

generating a density difference correction signal for correcting a density difference between an image density upon forward path printing by the printing head and an image density upon backward path printing by the printing head; and varying image density of image data for forward printing and backward printing depending upon generated density difference correction signal.

In a sixth aspect of the present invention, there is provided an image printing method reciprocating a plurality of printing heads and performing overlay printing of an image for a printing medium by the combined scans of forward path and backward path of a plurality of the printing heads, comprising the steps of:

generating a density difference correction signal for correcting a density difference by the combined scans of forward path and backward path of a plurality of the printing heads; and varying image density of image data upon printing by the combined scans of the forward path and the backward path depending upon the generated density difference correction signal.

In a seventh aspect of the present invention, there is provided an image printing method reciprocating a printing head to performing printing of an image for a printing medium, comprising the steps of:

printing test images in forward path scan and backward path scan of the printing head;

reading the printed test images;

generating a density difference correction signal for correcting a density difference between the test image density upon forward path printing by the printing head and the test image density upon backward path printing by the printing head; and varying image density of image data for forward printing and backward printing depending upon generated density difference correction signal.

In an eighth aspect of the present invention, there is provided an image printing apparatus reciprocating a plurality of printing heads and performing overlay printing of an image for a printing medium by the combined scans of forward path and backward path of a plurality of the printing heads, comprising the steps of:

printing test images by the combined scans of forward path and backward path scan of the printing heads;

reading the printed test images;

generating a density difference correction signal for correcting a density difference of the test images formed by the combined scans of forward path and backward path of a plurality of the printing heads; and varying image density of image data upon printing by the combined scans of the forward path and the backward path depending upon the generated density difference correction signal.

The above and other objects, effects, features and advantages of the present invention will become more apparent from the following description of the embodiments thereof taken in conjunction with the accompanying drawings.

BRIEF DESCRIPTION OF THE DRAWINGS

FIG. 24 is an explanatory illustration showing one example of a pallet data;

DESCRIPTION OF THE PREFERRED EMBODIMENT

The preferred embodiments of the present invention will be explained hereinafter in detail with reference to the drawings.

The first embodiment of the present invention will be explained with reference to FIGS. 1 to 8 and 11 to 24.

At first, a general construction of the shown embodiment of an apparatus will be explained on the basis of FIGS. 11 to 24.

(1) Overall Construction of System

Figure 11:
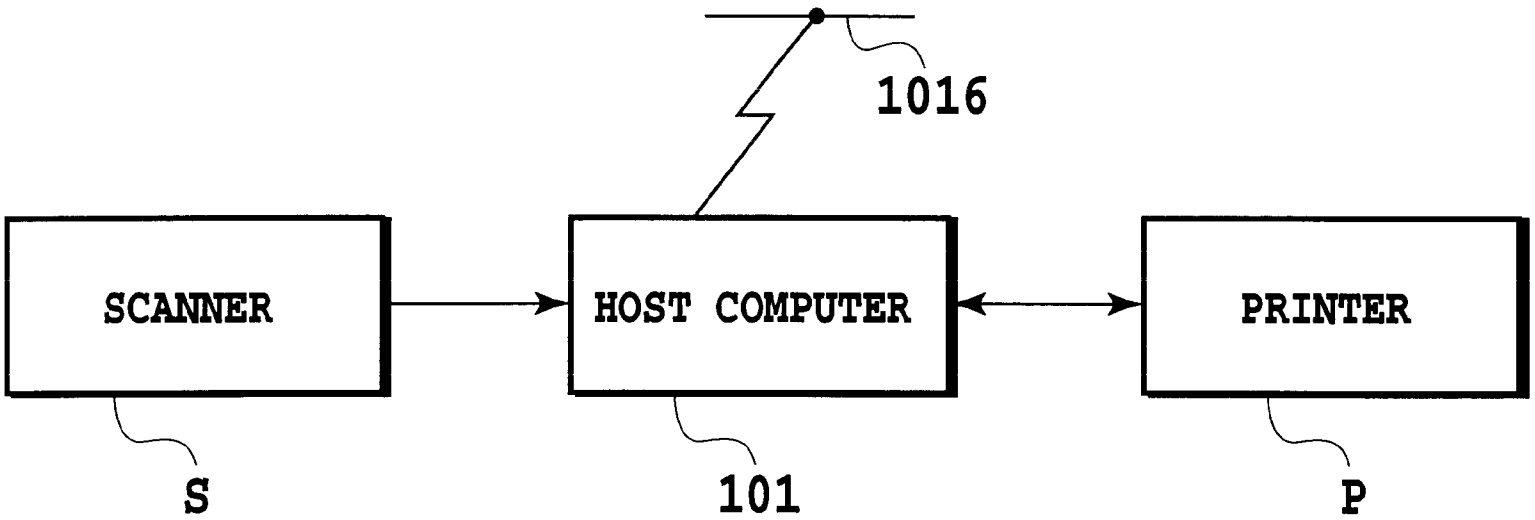
FIG. 11 is a block diagram showing a system according to the present invention.
Figure 12:
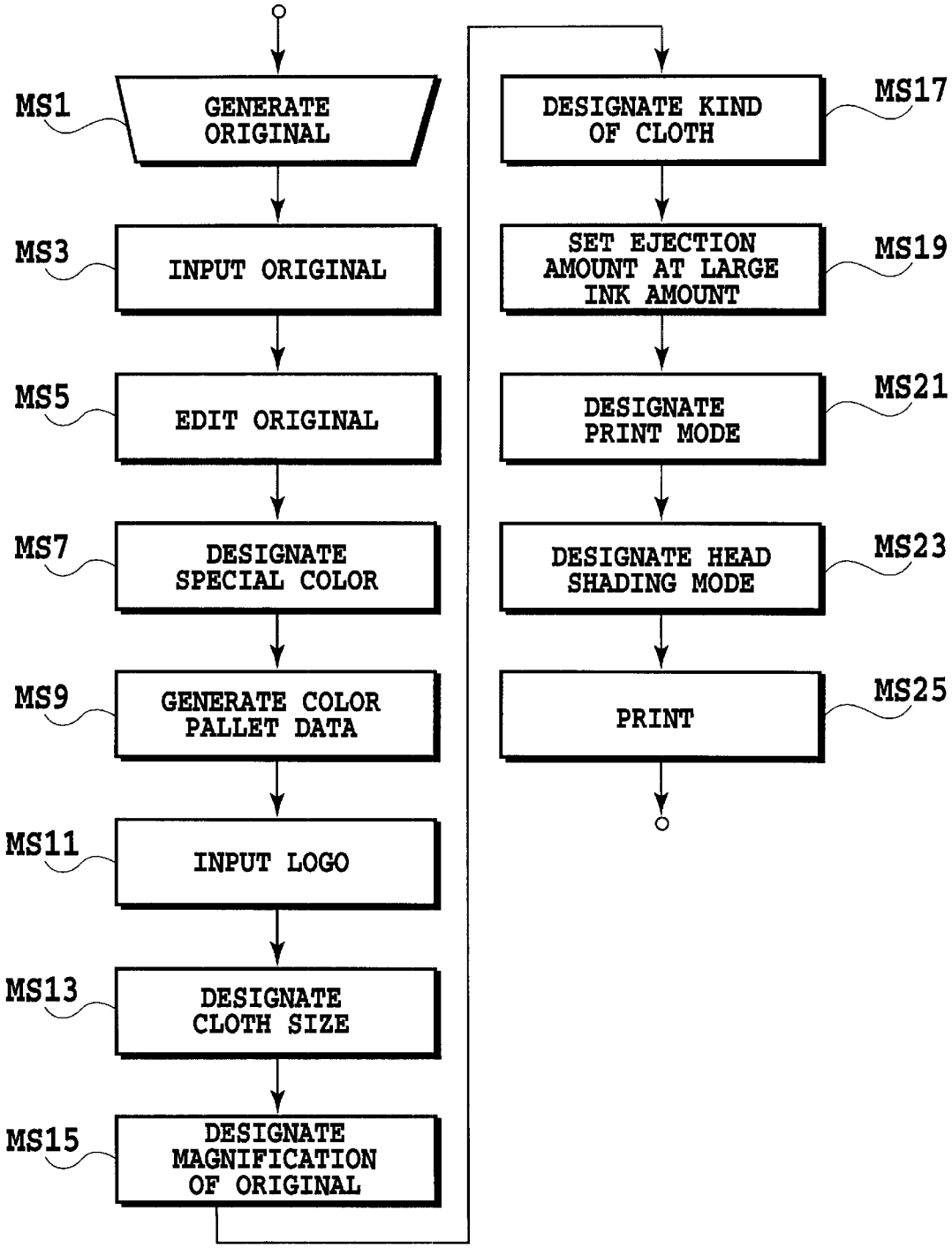
FIG. 12 is a flowchart showing a flow of a process of the system according to the present invention.
Figure 13:
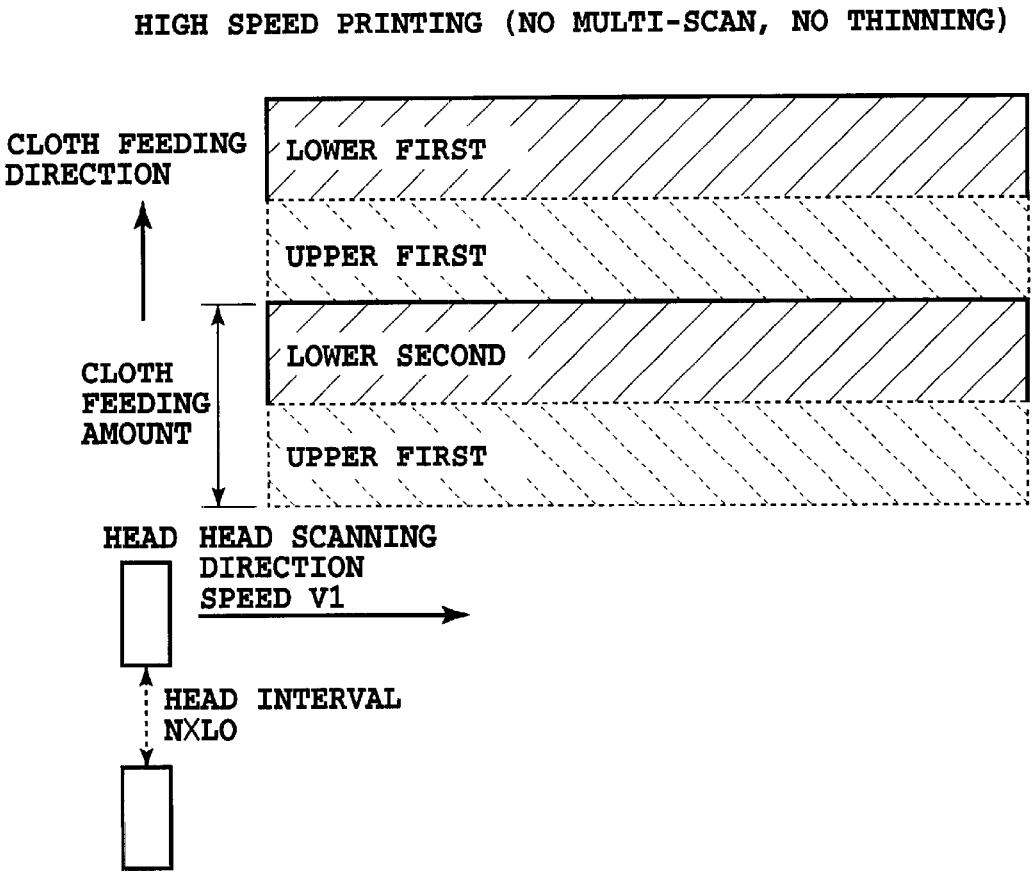
FIG. 13 is an explanatory illustration showing an example not performing a printing by multi-scan.
Figure 14:
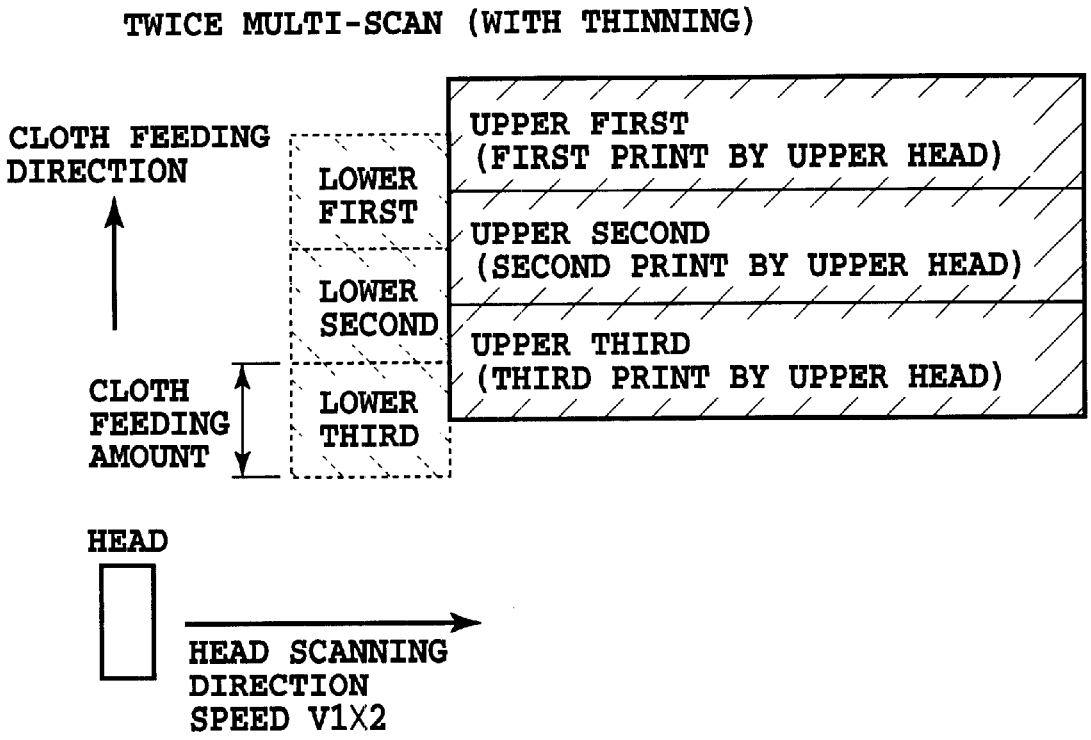
FIG. 14 is an explanatory illustration showing an example performing overlay printing by a multiple scan.
Figure 15:
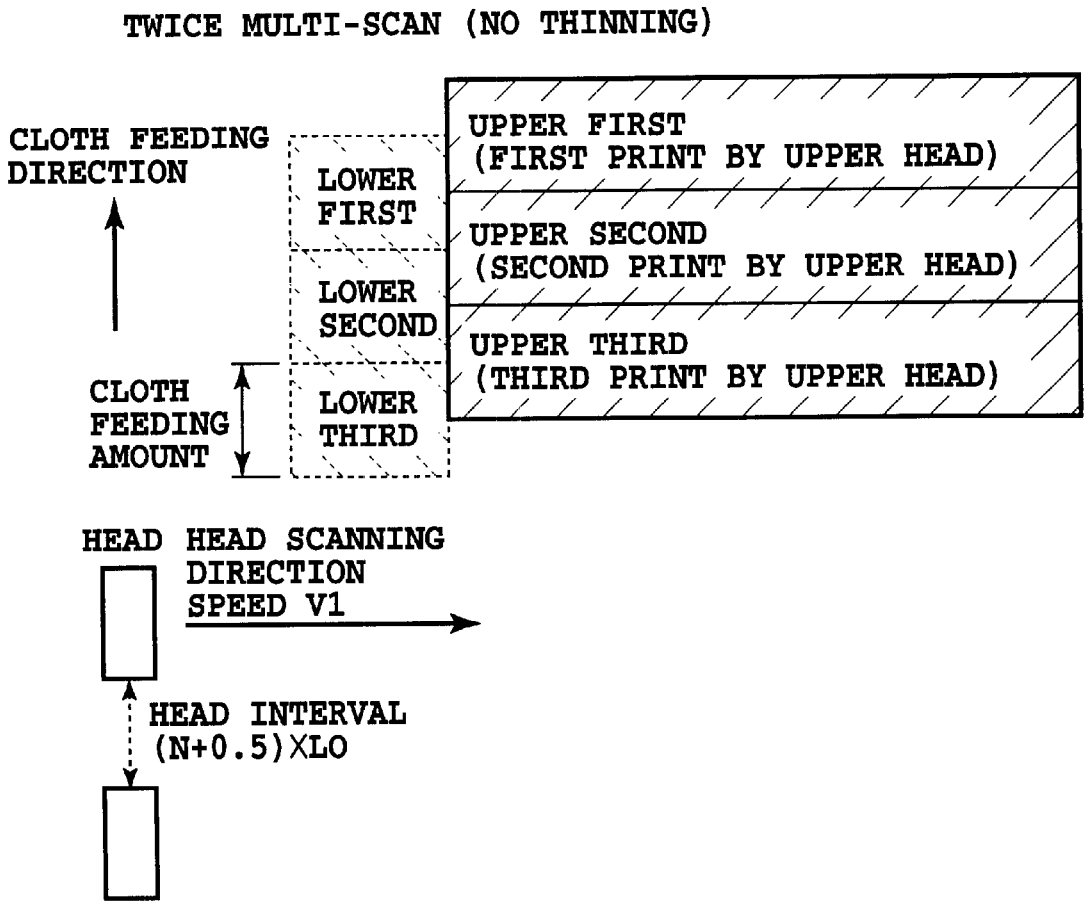
FIG. 15 is an explanatory illustration showing another example performing overlay printing by multi-scan.

FIG. 11 shows an overall construction of a cloth printing system. A host computer 101 forms a data supply system supplying an original image data, other control command and so on for cloth printing to a printer P performing printing on a printing medium, such as cloth and so on. By means of the host computer, a desired edition is given for an original image drafted by a designer and scanned by a scanner S to perform cloth printing by setting a desired parameter to the printer P. The host computer 101 is enabled to communicate with other systems by connecting with a LAN 1016 (Local Area Network). On the other hand, to the host computer 101, status is noticed from the printer P. The host computer 101 will be described in detail with reference to FIG. 16 later and the printer P will be described in detail with reference to FIG. 17 later.

FIGS. 12 to 15 show one example of a procedure of a cloth printing process by the shown embodiment of the cloth printing system. The process contents to be performed in respective steps are as follows, for example.

(Original Drafting Step MS1)

This is a step that a designer drafts an original image namely a basic image to be a basic unit of a repeated image on a cloth as the printing medium, by means of an appropriate means. Upon drafting of the original image, necessary portions of the host computer 101, such as input means, display means and so on, may be used.

(Original Input Step MS3)

This is a step for reading the original image drafted in the original drafting step MS1 to the host computer H by means of a scanner S, for reading an original data stored in an external storage device of the host computer 101 or receiving an original data by the LAN 1016.

(Original Editing Step MP5)

The shown embodiment of the cloth printing system permits selection of various repeat pattern with respect to a basic image. However, in certain selected repeat image, unwanted offset of the image or discontinuity of color tone can be caused in a boundary portion. This step accepts selection of the repeat pattern and performs correction of discontinuity in the boundary portion of the repeat pattern depending upon selection. As a manner of correction, with reference to a display screen incorporated in the host computer 101, the designer or operator may perform correction by means of input means, such as mouse or the like, or the host computer 101 per se may automatically perform correction by its own image processing.

(Special Color Designating Step MS7)

In the shown embodiment of the printer P, printing is performed using basically, yellow (Y), magenta (M) and cyan (C), or further black (BK) inks. In cloth printing, colors other than these colors, such as metallic color including gold, silver and so on, clear red (R), clear green (G), clear blue (B) and so on may be desired. In the shown embodiment of the printer P, printing using these special colors (hereinafter referred to as special color) of inks is enabled. In conjunction therewith, designation of the special colors is performed in this step.

In designing, the designer prepares the original image with selecting colors from a standard color patch. Reproduction ability of the colors upon printing of the selected colors significantly affect the productivity of the cloth printing system. Therefore, in this step, in order to satisfactorily reproduce selected standard colors, data determining the mixture ratio of Y, M, C and/or the special color is generated.

(Logo Inputting Step MS11)

In case of trademarked goods, it is typical to print a logo mark of designer, bland of maker or the like at the end portion. In this step, designation of such logo mark and designation of color, size, position and so on of the designated logo mark are performed.

(Cloth Size Designation Step MS13)

Width, length and so on of the cloth as printing object are designated. By this, scanning amounts in the primary scanning direction and auxiliary scanning direction of the printing head and number of times of repeating of the original pattern in the printer P are determined.

(Original Magnification Designation Step MS15)

Variable power ratio (e.g. 100%, 200%, 400% and so on) relative to the original upon printing is set.

(Cloth Kind Designation Step MS17)

The cloth includes various kinds, such as natural fiber including cotton, silk, wool and so on, synthetic fiber including nylon, polyester, acrylate and so on, and other fibers to differentiate characteristics in cloth printing. Also, appearances of a stripe formed in the boundary portion along the primary scan becomes different when a feeding amount upon printing is set the same and varied based on recording medium being used. It is considered that such difference is caused due to difference of stretching ability of the clothes. Therefore, in this step, kind of the cloth to be used for printing is input to set appropriate feeding amount in the printer P.

(Ink Maximum Deposit Amount Setting Step MS19)

When the same amount is deposited on the cloth, an image density reproduced on the cloth can be different depending upon the type of cloth. On the other hand, the ink amount which can be deposited, is differentiated depending upon construction of a fixing system in the printer P or so on. Therefore, in this step, the maximum deposit amount of the ink is designated depending upon kind of the cloth and/or construction or so on of the fixing system of the printer P.

(Printing Mode Designation Step MS21)

In the printer P, designation is made to perform high speed printing mode not performing overlay printing by multiple scan (see FIG. 13), to perform a mode performing overlay printing (see FIGS. 14 and 15) by multiple scan, or to perform ink ejection for one time or plurality of times for one dot. Furthermore, upon interruption of printing or similar occasion, it is possible to designate to perform control for maintaining continuity of patterns before and after interruption, or to newly initiate printing irrespective of continuity of pattern.

(Head Shading Mode Designation Step MS23)

When a printing head h having a plurality of ejection openings (nozzles) is employed in the printer P, unevenness of ink ejection amount and/or ink ejecting direction, or kink can be caused due to tolerance in fabrication, subsequent use condition and so on. Therefore, a drive signal for each ejection opening is corrected to perform processing (head shading) for making printing density uniform for correcting the unevenness and kink set forth above. In this step, mode of head shading depending upon the printing mode, timing of performing head shading and so on can be designated.

(Printing Step MS25)

On the basis of the foregoing designations, cloth printing is performed by the printer P.

It should be noted that if a designation and so on is not necessary in the foregoing process, the corresponding step may be omitted or skipped. Also, the step for performing other designations and so on may be added.

(2) Host Computer

Figure 16:
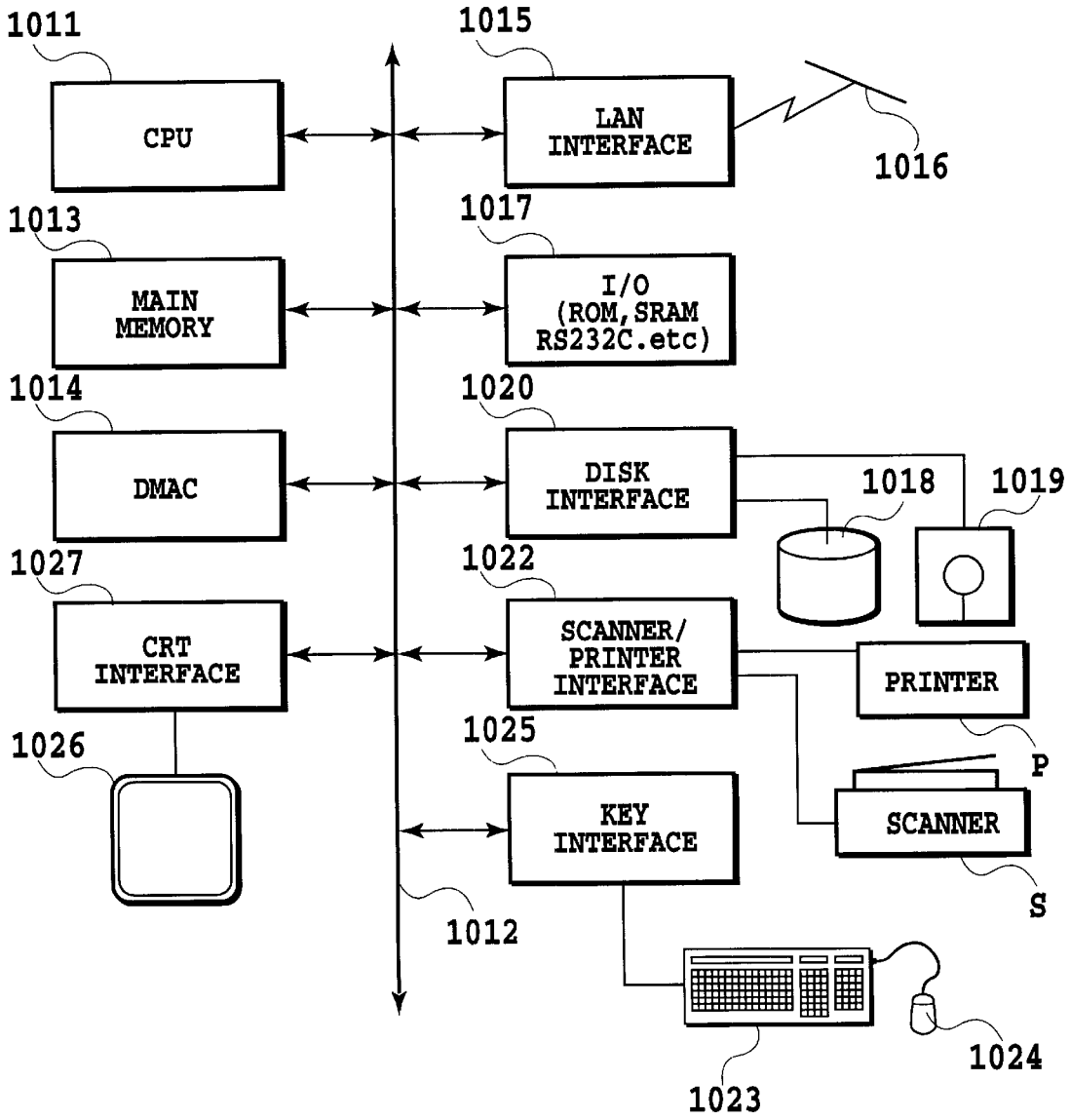
FIG. 16 is a block diagram showing a construction of the overall system primarily showing a construction of a host.

FIG. 16 is a block diagram showing a construction of the overall system primarily showing a construction of the host computer 101.

In FIG. 16, the reference numeral 1011 denotes CPU executing control of the overall information processing system. The reference numeral 1013 is a main memory for storing program to be executed by CPU 1011 and to be used as a work region upon execution. The reference numeral 1014 denotes a DMA controller (Direct Memory Access Controller: hereinafter referred to as DMAC) performing transfer of data between the main memory 1013 and various devices forming the shown system directly not via CPU 1011. The reference numeral 1015 denotes a LAN interface between LAN 1016 and the shown system. The reference numeral 1017 denotes an input/output unit (hereinafter referred to I/O) having ROM, SRAM, RS232C type interface and so on. To the I/O 1017, various external devices can be connected. The reference numerals 1018 and 1019 denotes a hard disk device and a floppy disk device as external storage devices. The reference numeral 1020 denotes a disk interface for performing signal connection between the hard disk device 1018 or the floppy disk device 1019 and the shown system. The reference numeral 1022 denotes a scanner/printer interface for performing signal connection the printer P and the scanner S with the host computer 101. The scanner/printer interface can be one of GPIB specification. The reference numeral 1023 denotes a keyboard for inputting various character information, control information and the like, 1024 denotes a mouse as a pointing device, 1025 denotes a key interface for establishing signal connection of the keyboard 1023 and the mouse 1024 with the shown system, and 1026 denotes a display device, such as CRT or the like, which is controlled display by an interface 1027. The reference numeral 1012 denotes a system bus consisted of data bus, control bus and address bus for establishing signal connection between respective devices.

(System Operation)

Operation of the shown system will be explained. In the system formed by connecting various devices as set forth above, the designer or operator performs an operation by corresponding various information displayed on the display screen of the CRT 1026. Character and image information and so on to be supplied from external devices connected to the LAN 1016 and I/O 1017, the hard disk 1018, the floppy disk 1019, the scanner S, the key board 1023 and the mouse 1024, or operation information concerning system operation stored in the main memory 1013 are displayed on a display screen of the CRT 1026. The designer or operator performs designations of various information and designating operations for the system with a display.

(3) Printer (Explanation of Mechanical Construction)

Figure 17:
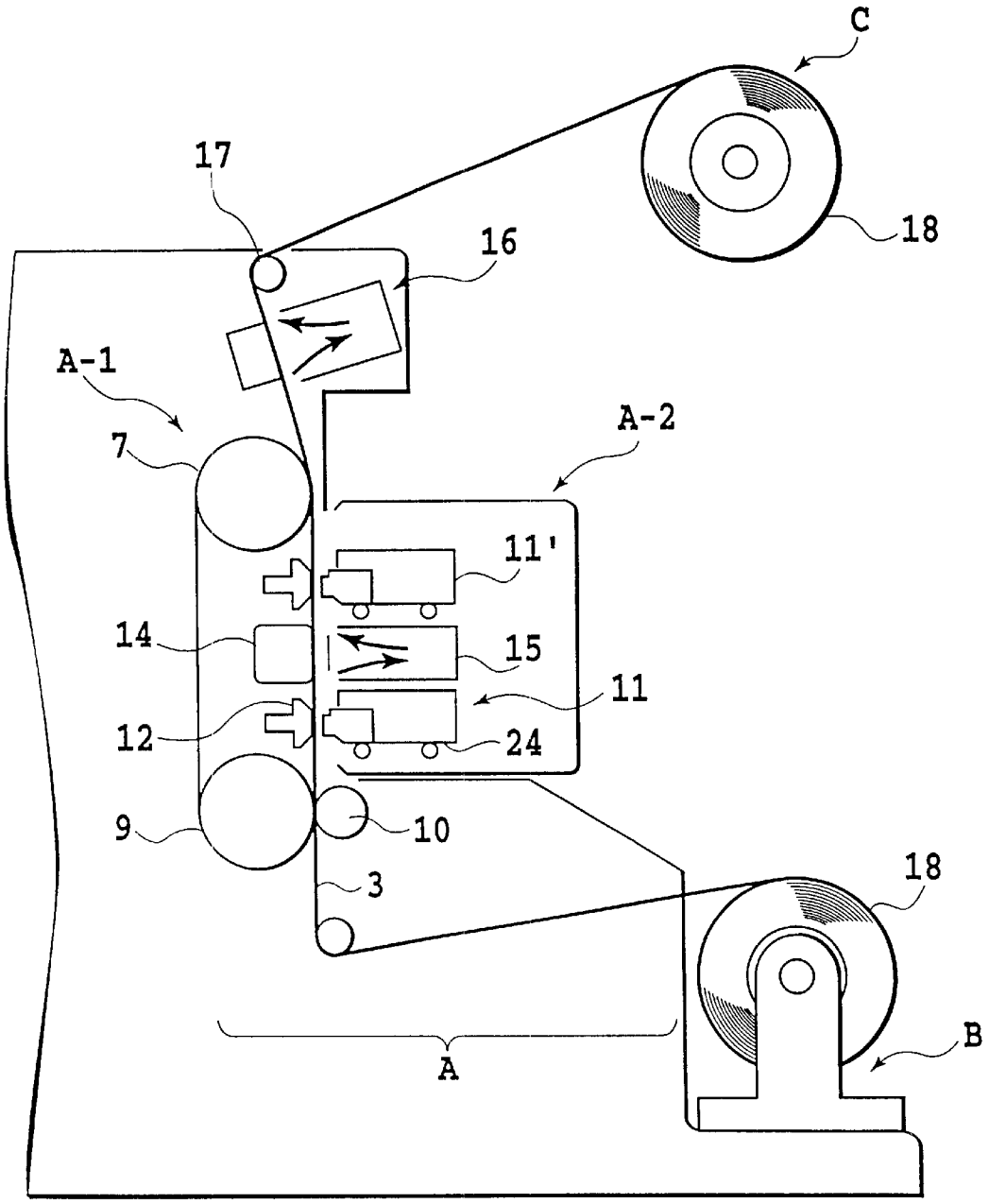
FIG. 17 is a front elevation showing an example of the construction of an ink-jet printer.

FIG. 17 shows an example of construction of the ink-jet printer as the cloth printing apparatus. In the shown embodiment of the cloth printing apparatus (printer) is generally constructed with a cloth feeding portion B for feeding the rolled cloth provided preliminary process for cloth printing, a main body A portion performing printing operation by the ink-jet head with precise line feeding of the fed cloth, and a taking up portion C for drying and taking up the printed cloth. Then, the main body A is constructed with a precise feeding portion A-1 including a platen for feeding the cloth and a printing unit A-2.

The preliminarily processed rolled cloth (cloth) 3 is fed to the cloth feeding portion B and fed into the main body portion A. In the main body, a thin endless belt 6 precisely driven in stepwise fashion is wrapped around a drive roller 7 and a driven roller 9. The drive roller 7 is directly driven by a high precision stepping motor (not shown) in stepwise fashion for feeding the belt in a stepping amount. The fed cloth is backed up by the driven roller 9 to be depressed onto the belt surface by a depression roller 10 to restrict a printing surface in flat.

The cloth 3 fed by the belt in stepwise fashion is registered by a platen 12 on the back surface of the belt in a first printing portion 11 and is printed by an ink-jet head 13 from the surface side. Every time of completion of printing for one line, the cloth is fed in predetermined amount in stepwise fashion. Then, the cloth is dried by heating a heating plate 14 from the back surface of the belt and application of hot air through air duct 15. Subsequently, in a second printing portion 11', overlay printing is performed in the similar manner as the first printing portion 11. It should be noted that the heating plate 14 or the hot air duct 15 are not always required or either one can be provided. When the construction for promoting drying may cause adverse effect, natural drying may be performed in a region from the first printing portion 11 to the second printing portion 11'.

The cloth, for which printing is completed, is peeled off to be taken up on a take-up roller 18 as guided by a guide roller 17 after drying again by a drying portion 16 similar to the foregoing heating plate 14 and the duct 15. Then, the taken up cloth is removed from the shown system and subject to color development, washing and drying by a batch process to be products.

Figure 18:
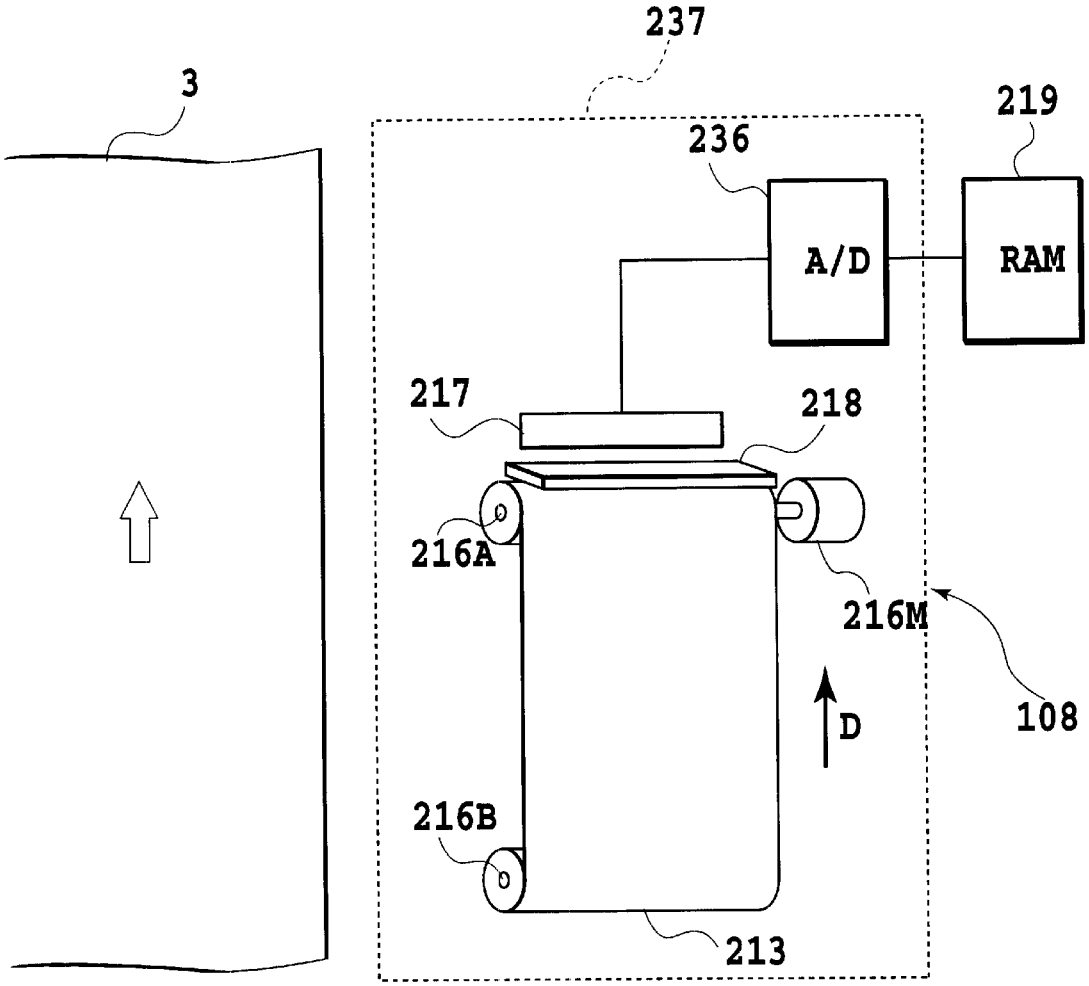
FIG. 18 is an illustration showing a construction of a head characteristic measuring device.

FIG. 18 shows a construction of a head characteristics measuring device 108 including a density unevenness correcting portion 237 constituted of a HS test pattern printing portion provided on the side portion of the system and a test pattern reading portion.

The reference numeral 213 denotes a printing medium for a test pattern provided in the scanning position of upper and lower carriage which can be printed by the ink-jet heads of the first and second printing portions 11 and 11', which printing medium is wrapped around rollers 216A and 216B to be stretched therebetween and is transported in a direction shown by arrow D by a motor 216M. Then, the printing medium 213 on which the test pattern is printed is irradiated by a light source 218 for reading printing density of the test pattern printed on the printing medium 213 by each ink-jet head by a line scanning sensor 217. Scanning signal of the test pattern printed by the printing head and scanned by the scanning sensor 217 is converted into digital signals by an A/D converter 236 as R, G, B signals. Thereafter, the scanning signals are temporarily stored in RAM 219.

(Construction of Control System of Apparatus)

Figure 19:
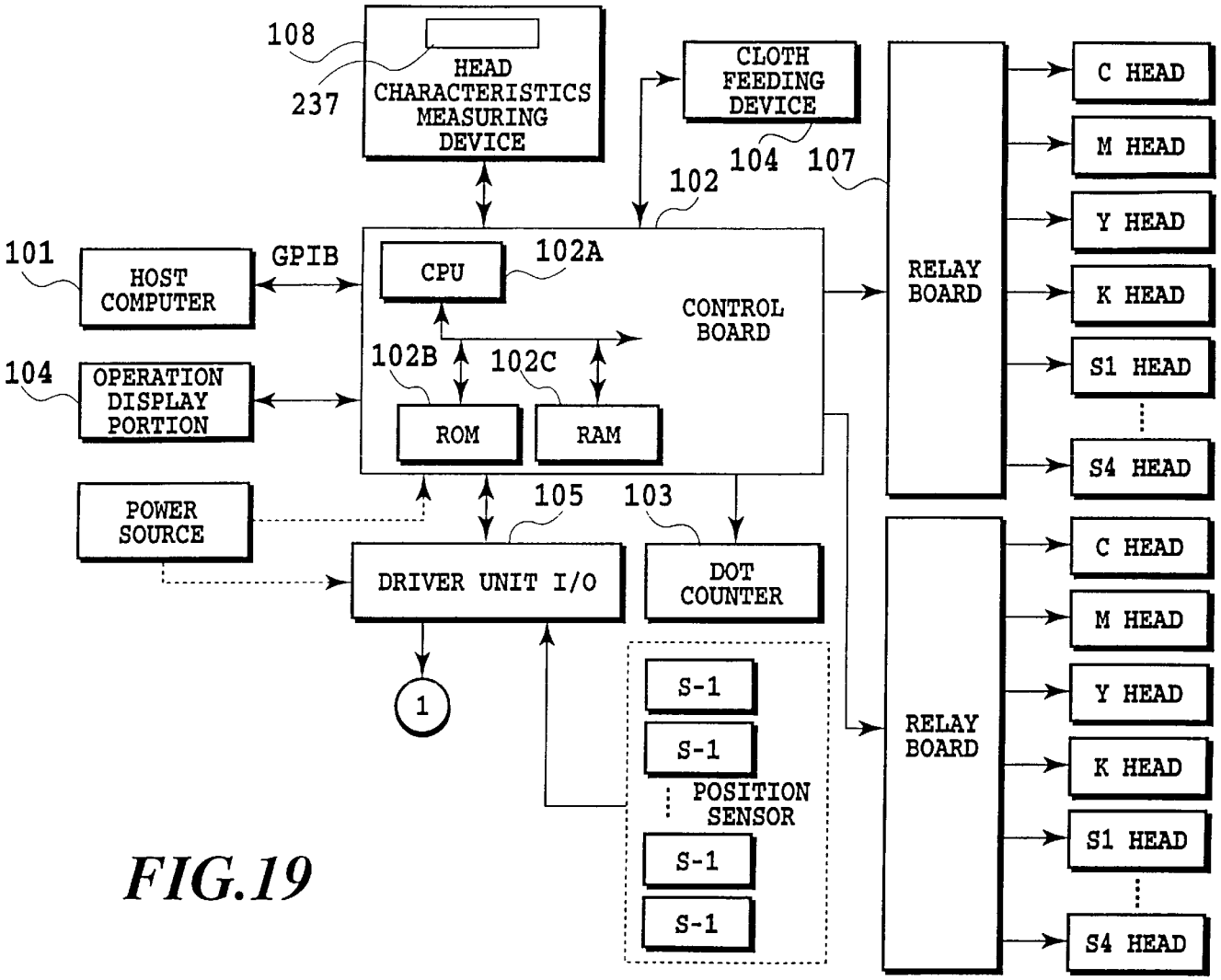
FIG. 19 is a block diagram showing a construction of a control system of a printing apparatus according to the present invention.
Figure 20:
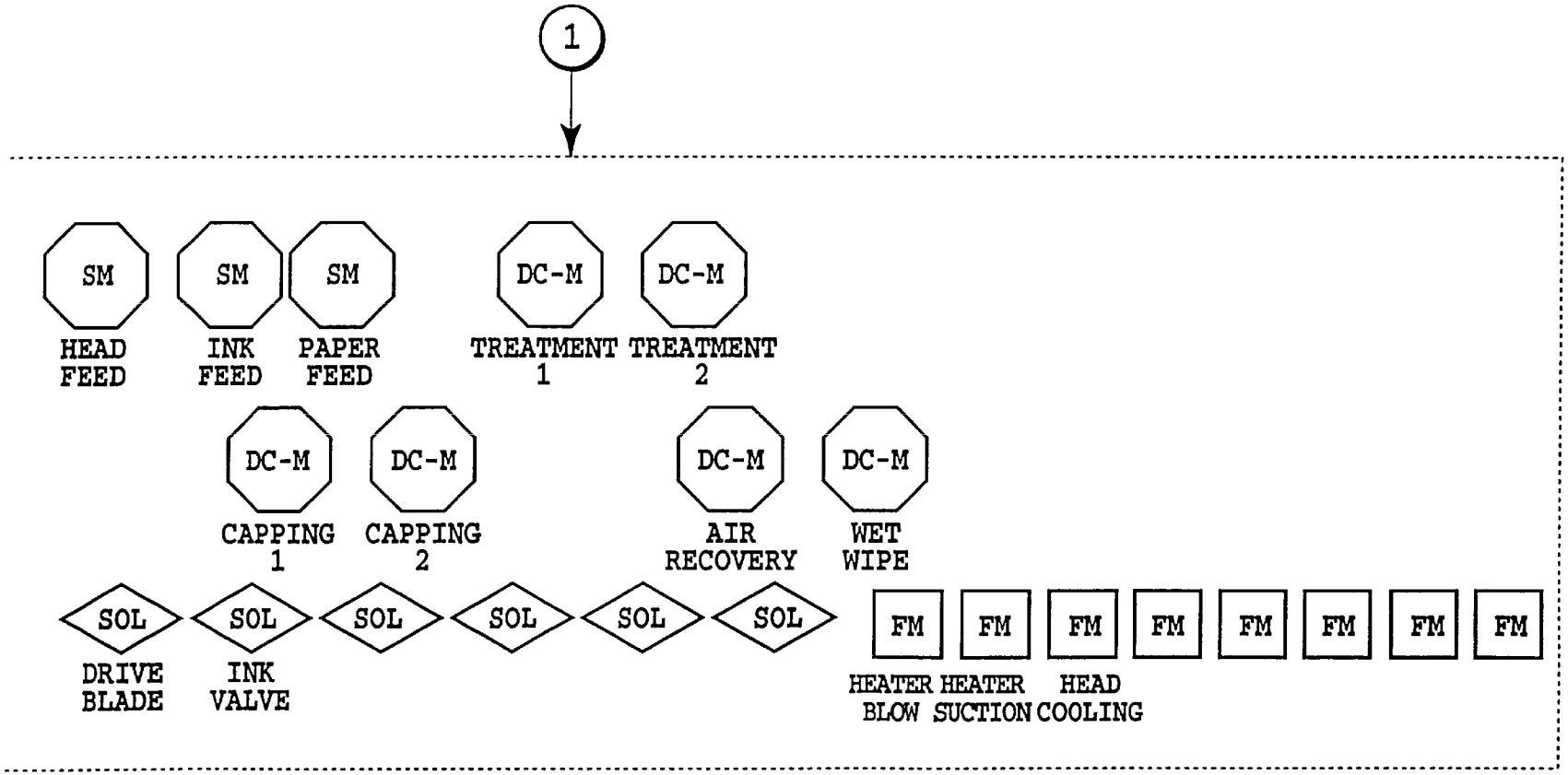
FIG. 20 is a front elevation showing a construction of an operating portion.
Figure 21:
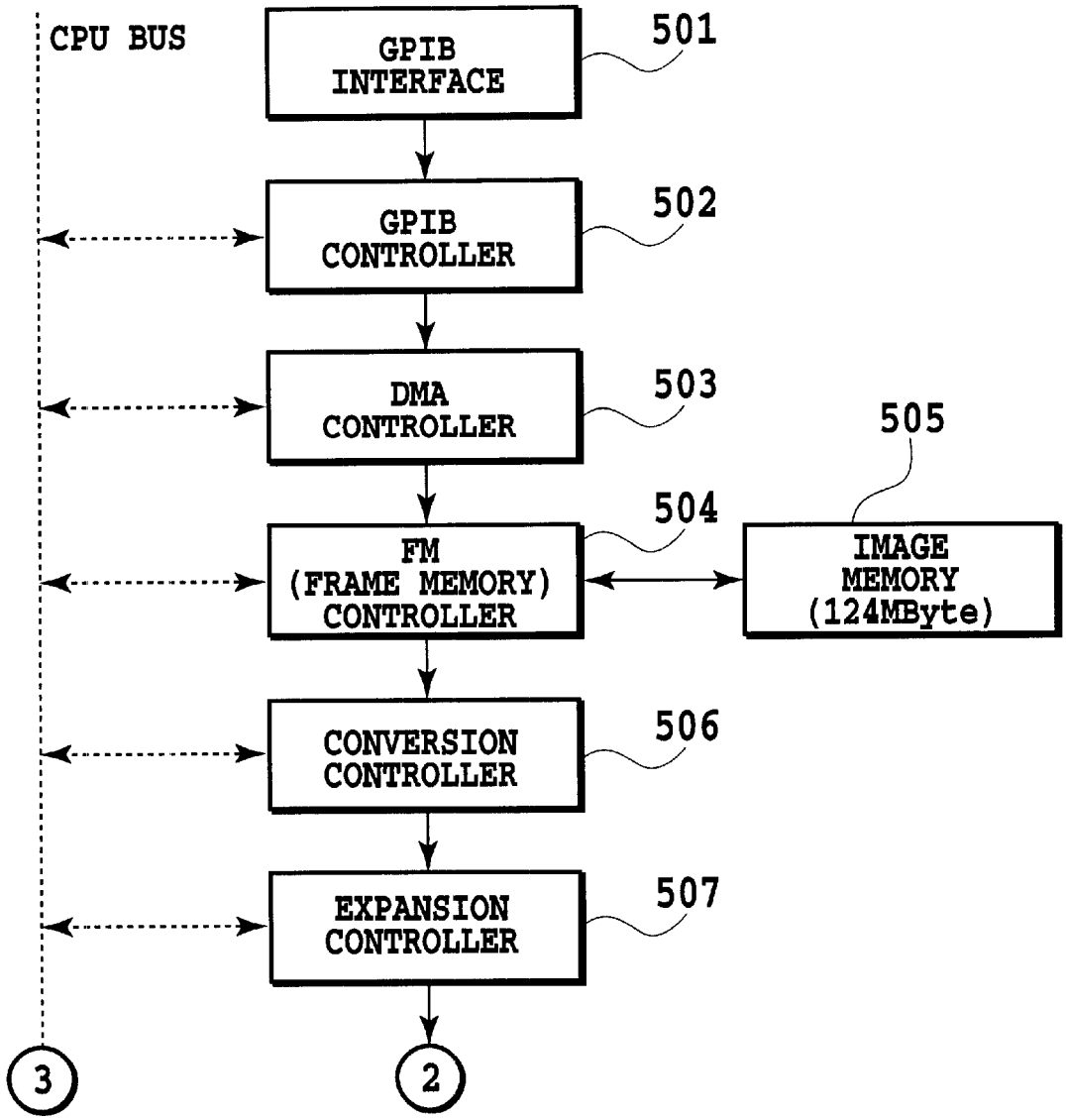
FIG. 21 is a block diagram showing a construction of a control board.
Figure 22:
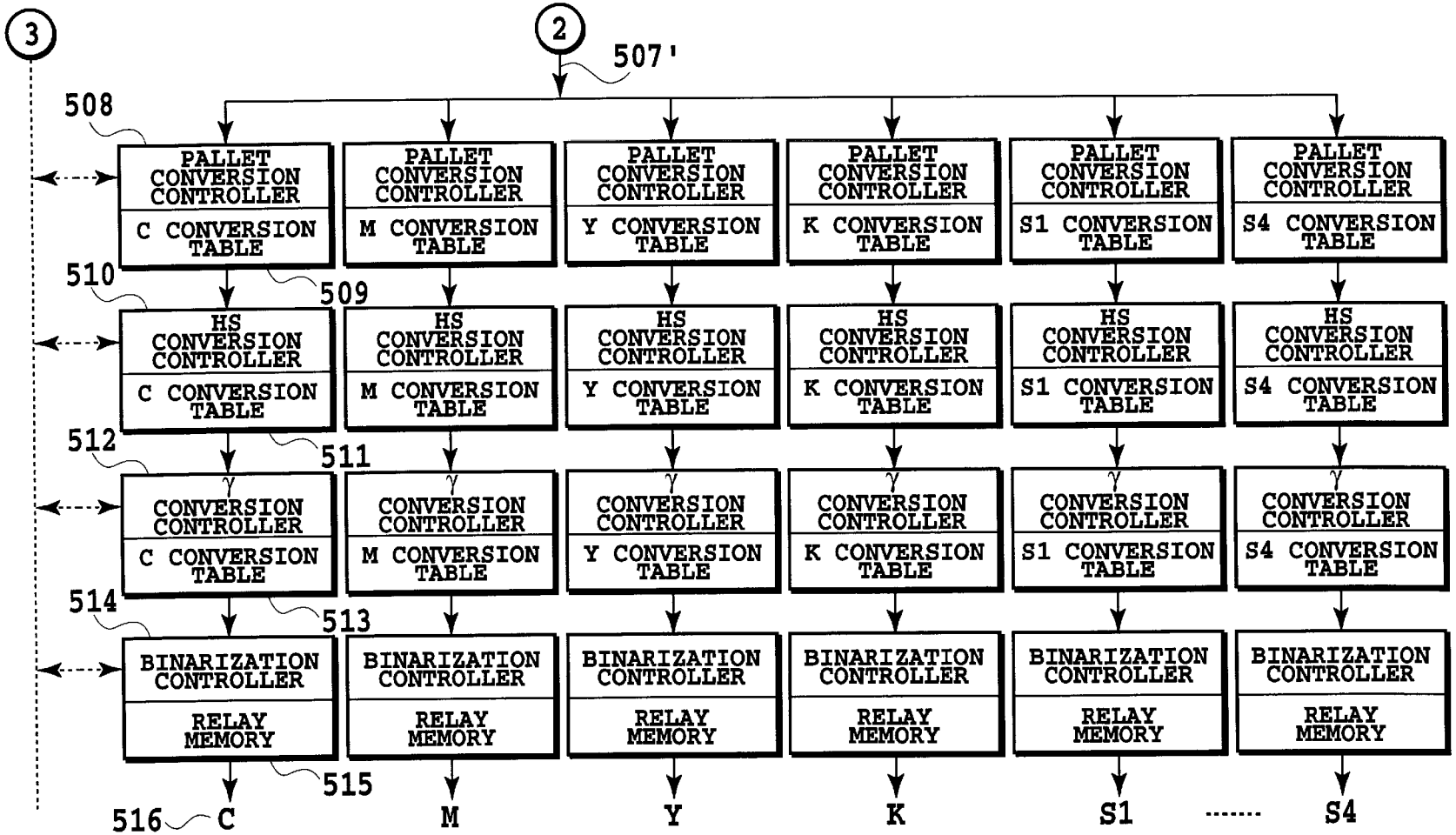
FIG. 22 is a block diagram showing a construction in the control board.
Figure 23:
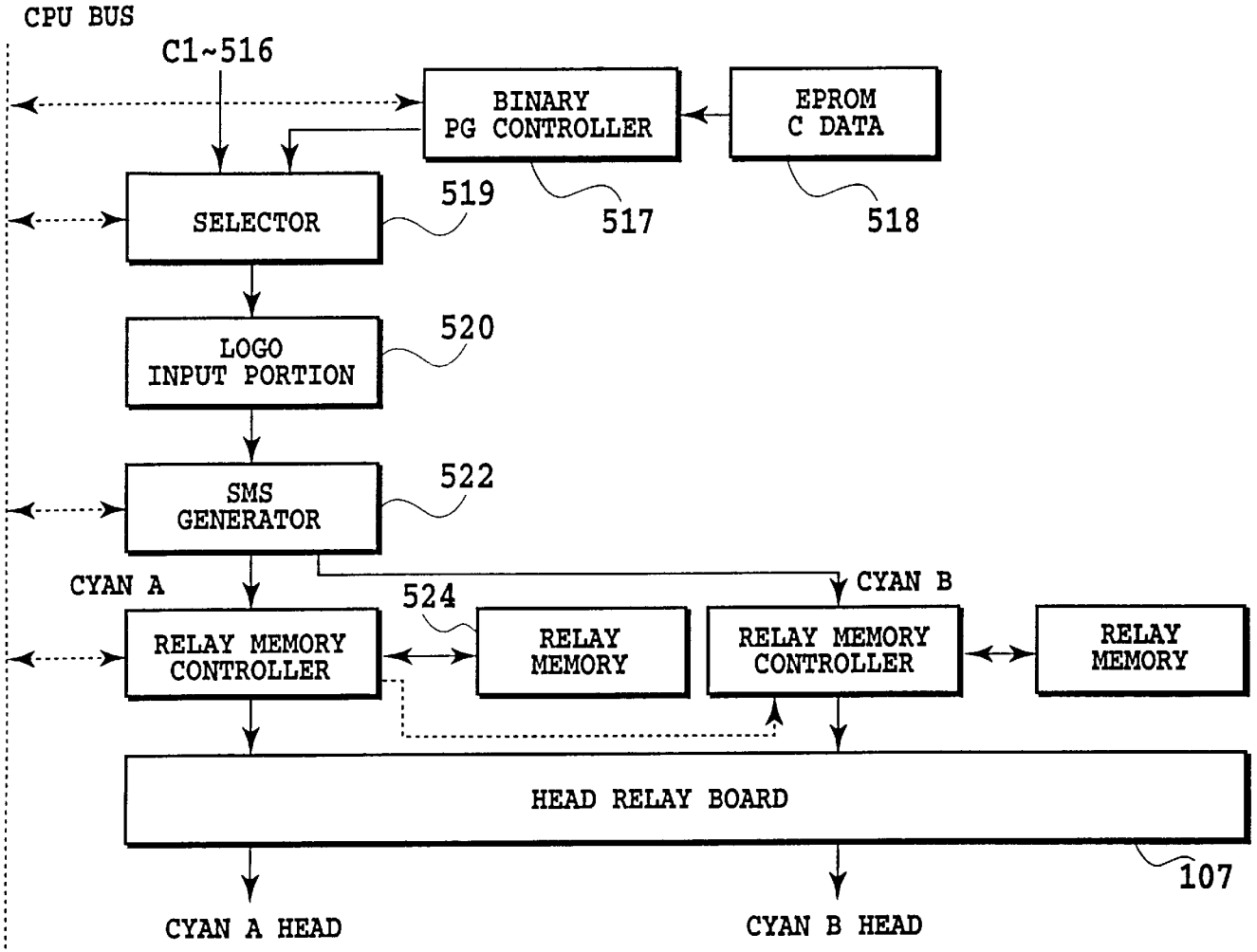
FIG. 23 is a block diagram showing a construction in the control board.
Figure 25A:
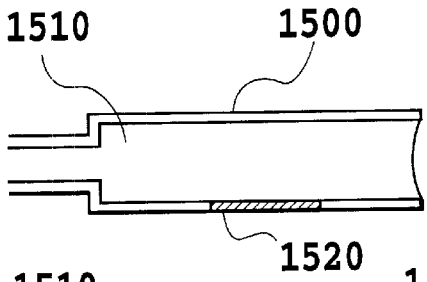
FIGS. 25A to 25G are illustrations for explaining prior art and showing process steps showing a liquid droplet ejecting process.
Figure 25B:
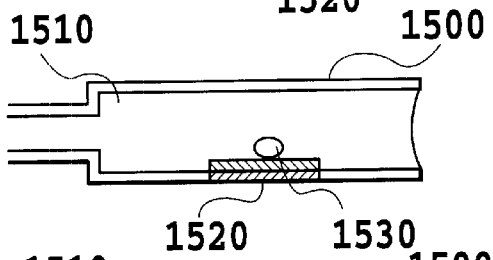
Figure 25C:
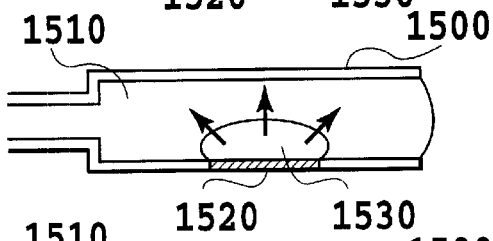
Figure 25D:
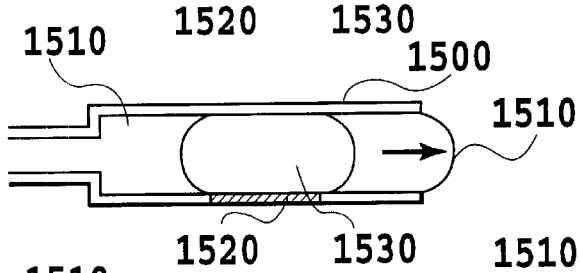
Figure 25E:
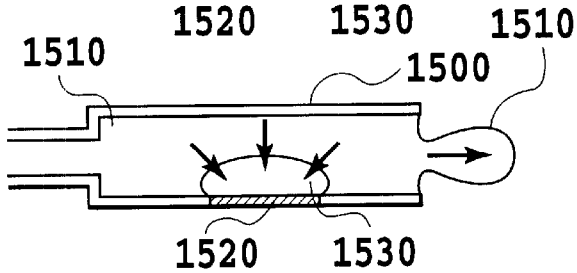
Figure 25F:
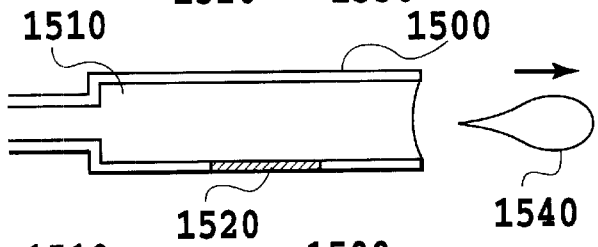
Figure 25G:
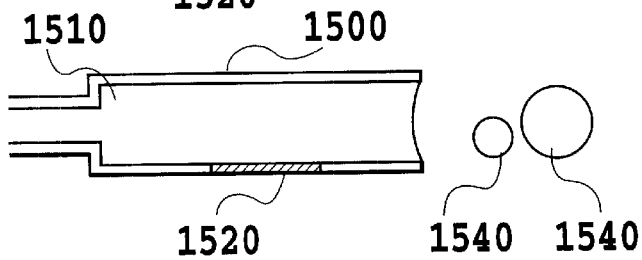
Figure 26:
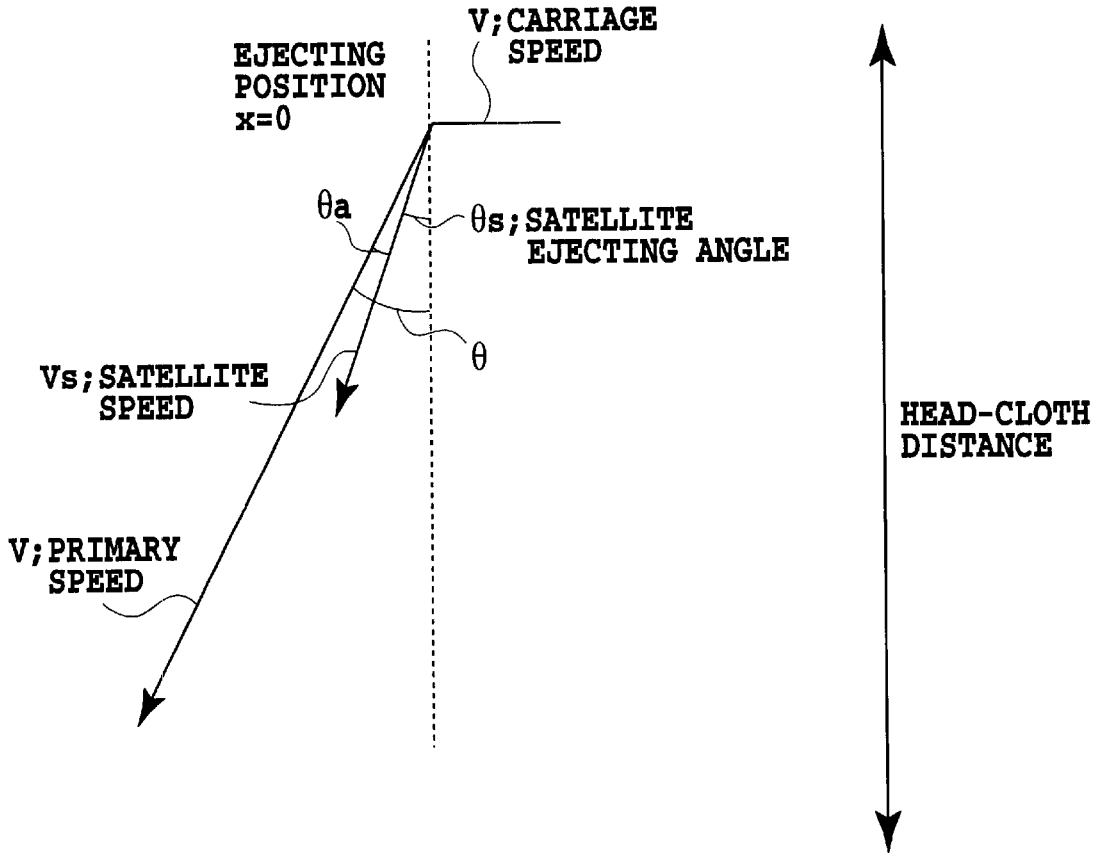
FIG. 26 is an explanatory illustration showing relationship of positions of the satellite relative to a primary droplet.
Figure 27A:
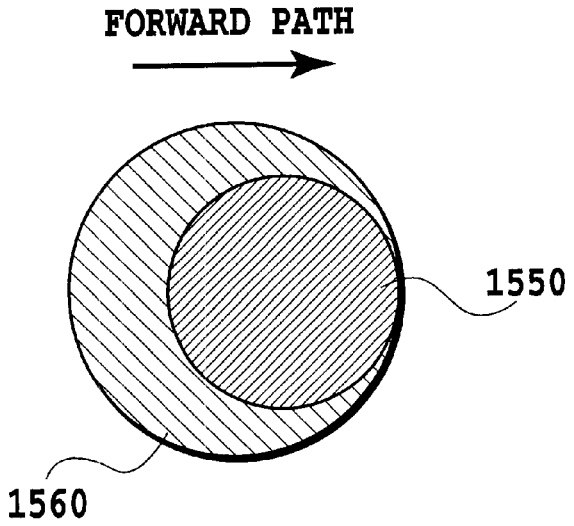
FIGS. 27A and 27B are explanatory illustrations showing conditions where flying positions of the primary droplet and the satellite are different in forward scan and backward scan.
Figure 27B:
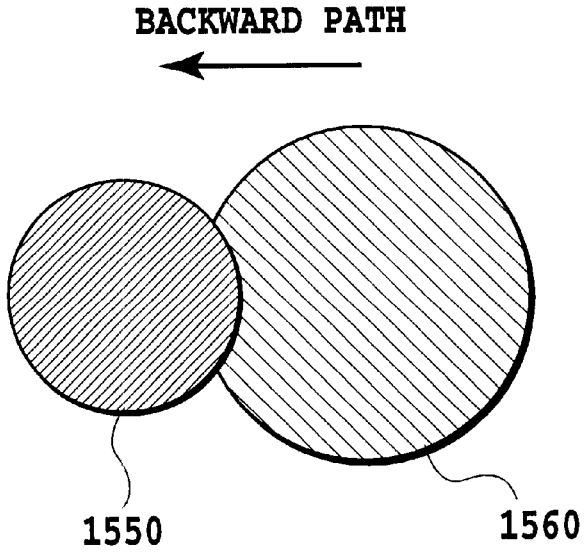

Next, a construction of a control system of the shown apparatus will be explained with reference to FIGS. 19 to 24. FIGS. 19 and 20 show example of a construction of the ink-jet printer and a construction of the operating portion thereof. FIGS. 21 to 23 conceptually show one example of an internal structure of a control board 102 along flow of data.

In FIG. 19, a printing image data is fed from the host computer 101 to the control board 102 via the interface (here GPIB). The apparatus for feeding the image data is not particularly limited and transmission mode can be transfer by network or by off line through a magnetic chip or the like. The control board 102 is constructed with CPU 102A, ROM 102B storing various programs, ROM 102C having various register regions or work regions and other portions shown in FIGS. 21 to 23 and so on, to perform control of the overall apparatus. The reference numeral 103 denotes an operating and displaying portion having an operating portion, through which the operator provides necessary command for the printer P and a display device for displaying message or the like to the operator.

The reference numeral 104 denotes a cloth transporting device constituted of a motor or the like for transporting the printing medium, such as cloth or the like as an object for printing. The reference numeral 105 denotes a driver unit input/output portion for driving various motors (identified by reference signs with "M" at the tail ends) shown in FIG. 20 and various solenoids (identified by "SOL"). The reference numeral 107 is a relay board for receiving information relating to respective head (information whether is head is loaded or not and information concerning color or the like to be printed by the head) and supplying to the control board 102. Such information is transferred to the host computer 101 as set forth above.

As shown in FIG. 21, when the information of the image data to be printed is received from the host computer 101, the image data is accumulated in an image memory 505 via a GPIB interface 501, controlled by GPIB controller 502, and a frame memory controller 504 (see FIG. 21). The shown embodiment of the image memory 505 has a capacity of 124 Mbyte for storing A1 size in 8 bit pallet data. Namely, 8 bits are assigned for one pixel. The reference numeral 503 denotes a DMA controller for speeding up memory transfer. Once, transfer from the host computer 101 is completed, printing is initiated after predetermined treatment.

While order of explanation is backward, the host computer 101 connected to the shown embodiment of the printing apparatus transfers the image data as a raster image. Since each printing head has a plurality of ink ejection openings aligned in longitudinal direction, alignment of the image data has to be converted adapting to the printing head. This data conversion is performed by a conversion controller 506. Then, the data converted by the conversion controller 506 is supplied to a pallet conversion controller 508 through an enlarging function of a next enlargement controller 507 for variable power of the image data. The data up to the enlargement controller 507 is the data fed from the host computer 101. Therefore, in the shown embodiment, the signal is the 8 bit pallet signal in the shown embodiment. Then, the pallet data (8 bit) is commonly transferred to the processing portion (which will be explained later) for each printing head, and processed.

The following explanation will be given for the case whether the printing heads are 8 printing heads, namely in addition to the heads printing yellow, magenta, cyan and black inks, the heads printing four special colors S1 to S4 are employed.

In FIG. 22, the pallet conversion controller 508 supplies the pallet data input from the host computer 101 and the conversion tables of the corresponding colors to a conversion table memory 509.

In case of the 8 bit pallet, kind of colors which can be reproduced is 256 kinds of 0 to 255. For example, the table shown in FIG. 24 are developed into corresponding table memory 509 per each color.

In case of the 8 bit pallet, kind of colors which can be reproduced is 256 kinds of 0 to 255, for example, the following process is performed:

when 0 is input, print of light gray;

when 1 is input, solid print of special color 1;

when 2 is input, solid print of special color 2;

when 3 is input, print of blue type color by mixing cyan and magenta;

when 4 is input, solid print of cyan;

when 5 is input, print of red type color by mixing magenta and yellow;

when 254 is input, solid print of yellow; and when 255 is input, nothing is printed.

A circuit construction of FIGS. 22 and 23 will be explained. The pallet conversion table memory 509 achieves its function by writing the conversion table at an address position relative to the pallet data. Namely, when the pallet data is actually supplied as address, the memory is accessed in read mode. It should be noted that the pallet conversion controller 508 performs management of the pallet conversion table memory 509, and interfacing of the control board 102 and the pallet conversion table memory 509. On the other hand, concerning the special color, between the next stage HS controller 510 and a HS system constituted of a HS conversion table memory 511, it is possible to insert a circuit for setting a special color mixing amount (circuit for multiplying 0 to one times) for making a set amount variable.

The HS conversion controller 510 and the HS conversion table memory 511 performs correction of unevenness of the printing density corresponding to each ejection opening of each head on the basis of the data measured by the head characteristics measuring means 108 including the density unevenness correcting portion 237 shown in FIG. 18 set forth above. For example, for the ejection opening having low density (small ejection amount), data conversion for increasing density is performed, for the ejection opening having high density (large ejection amount), data conversion for decreasing density is performed, for ejection opening having standard density, no data conversion causing variation of density is performed.

Next, a γ conversion controller 512 and a γ conversion table memory 513 are table conversion for increasing and decreasing overall density, per color. For example, when no conversion is performed, with a linear table,

0 is output for input of 0;

100 is output for input of 100;

210 is output for input of 210; and

255 is output for input of 255.

A next stage binarization controller 514 has pseudo tone function for inputting 8 bit tone data and outputting a binarized 1 bit pseudo tone data. Conversion of multi-value data into binary data can be performed by dither matrix, error diffusion method and so on. In the shown embodiment, any one of these method may be employed. While detail is omitted, in any case, any method performing tone expression by number of dots per unit area.

Here, the binarized data is once stored in relay memories 515 and then is used for driving respective printing heads. The binarized data output from respective relay memories 515 is output as respective data for C, M, Y, Bk and SD1 to S4. The binary signal for each color is provided similar process. Here, explanation will be given with paying attention to the binary data C. It should be noted that FIGS. 22 and 23 show a construction for cyan of the printing color and has the same construction for each color. FIG. 23 is a block diagram showing a circuit construction of the later stage of the relay memory 515 shown in FIG. 22.

The binarized signal is output to a sequential multi scan generator (hereinafter referred to as SMS generator) 522. However, since it is possible to perform test print by the apparatus alone by the pattern generators 517 and 518, the binarized signal is supplied to a selector 519. Of course, the switching of the selector 519 is controlled under control of CPU of the control board 102. When the operator performs the predetermined operation for the operating portion 103 (see FIG. 19), data from the binary pattern controller 517 for performing test printing. Accordingly, normally, data from the binary value controller 514 (relay memory 516) is selected. The reference numeral 520 denotes a logo input portion inserted between the selector 519 and the SMS generator 522. In case of the cloth printing, a logo mark of the bland or the like of the designer or maker is frequently put on the end portion. The logo input portion 520 is adapted for this. The construction can be constructed with a memory storing the logo mark, controller for managing printing position and so on. Necessary designation or the like can be performed by step MS11 of FIG. 12 set forth above.

It should be noted that the SMS generator 522 is adapted to avoid density unevenness of the image due to variation of the ejection amount per nozzle. The multi scan has been proposed in European Patent Application Laid-open No. 0517544. Whether preference is given for image quality by performing ink ejection from a plurality of ejection openings for one pixel or for high speed printing ability without performing multi scan, can be designated by step MS21 of FIG. 12, set forth above. The printing system to be controlled by the SMS generator 522 will be explained later.

The relay memory 524 is a buffer memory for correcting physical position of the head, position between upper and lower printing portions or position between respective heads. The image data is once input to the relay memory 524 and output at a timing corresponding to the physical position of the head. Accordingly, the capacities of respective relay memories are different in respective printing colors.

After performing data processing set forth above, the data is fed to the head via a head relay board 107.

On the other hand, conventionally, data for pallet conversion, γ conversion are fixedly stored in the memory provided in the apparatus main body. Therefore, when the stored data does not match with the image data to be output, it is possible that satisfactory image quality cannot be obtained. Therefore, in the shown embodiment, external input of the data for conversion is permitted to store in each conversion table memories.

For example, a pallet data for conversion as shown in FIG. 24 is downloaded to the conversion table memory 509. Namely, all of the conversion table memories 509, 511 and 513 are formed with RAMs. Then, the data for pallet conversion and γ conversion are fed from the host computer 101. Data of the Hs conversion table memory 511 is input by the head characteristics measuring device 108 including the construction of the density unevenness correction data 237 shown in FIG. 18 so that data adapted to the head condition can be obtained constantly. In order to obtain head characteristics of each printing color by the head characteristics measuring device 108, test print (printing is performed at a predetermined uniform half tone density) is performed by each printing head. Then, density distribution corresponding to the printing width is measured. The condition of the head represents unevenness of the ejecting condition of a plurality of nozzles included in the head or deviation of the density of the image after printing by the head relative to a desired density.

(Explanation of Head Shading)

The image signal read out from a test pattern which will be explained later, is fed to an image forming portion to be used for correction of the drive condition of the printing head as will be described later.

In the present invention, meaning of adjustment for avoiding occurrence of density unevenness upon image formation includes at least one of making the image density to be formed by the liquid droplet ejected from a plurality of ejection openings of the printing head uniform by the printing head per se, making the image density per the printing head uniform, and performing unification for obtaining desired color or desired density in a desired color to be obtained by mixing a plurality of liquids, and preferably satisfies plurality of these.

Therefore, as density unifying correction means, it is preferred to automatically read a reference print providing a correcting condition to determine the correcting condition automatically. However, manual adjustment device for fine adjustment, user adjustment may also be added.

Correction to be attained by the correcting condition may be adjustment into a predetermined range including an acceptable range, a reference density variable depending upon the desired image as well as optimal printing condition, and may include all items adapted for the purpose of correction.

(Density Unevenness Correction Process According to Present Invention)

Next, the concrete process of the density correction according to the present invention will be explained with reference to FIGS. 1 to 8. This example shows the process in which density unevenness is corrected by reciprocal printing using a single head group (printing head h). Here, correction of the density unevenness referred to herein is the process upon HS conversion after pallet conversion (see FIG. 22).

Figure 1:
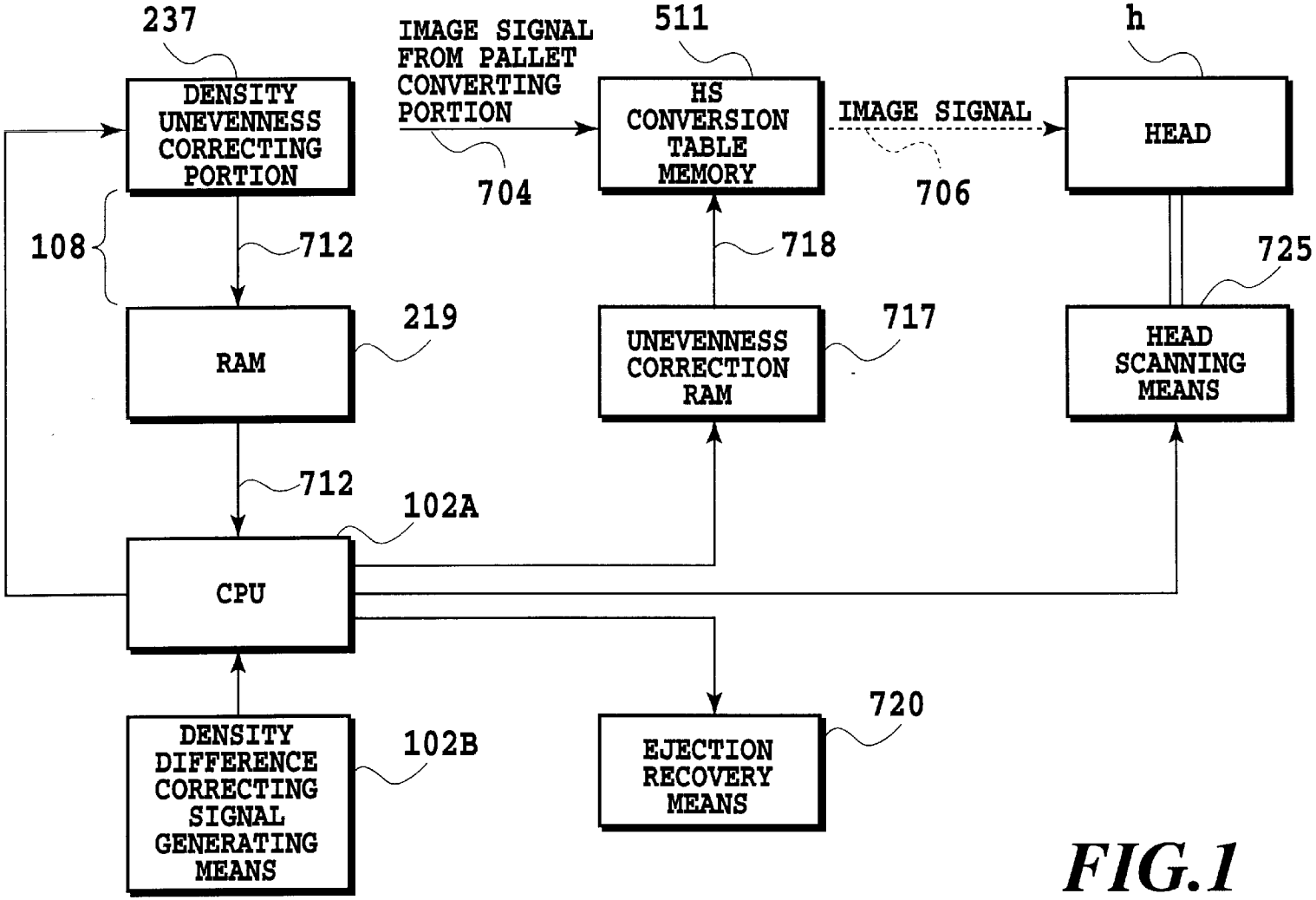
FIG. 1 is a block diagram showing a circuit construction performing the first and second embodiments of a density correction process according to the present invention.

FIG. 1 shows a construction of a control system of the shown embodiment of the apparatus primarily including a head shading (HS) system. The head characteristics measuring device 108 including the density unevenness correcting portion 237 and RAM 219 (see FIGS. 18 and 19) is a device for measuring an image density. CPU 102A performs correction process of density unevenness using a program 102B.

The reference numeral 717 denotes correction RAM for storing an unevenness correcting signal 718 obtained by the correction process. The unevenness correcting signal 718 is a signal selected among 64 kinds of 0 to 63 and stored in number corresponding to number of the ejection openings (hereinafter also referred to as nozzles).

Figure 6:
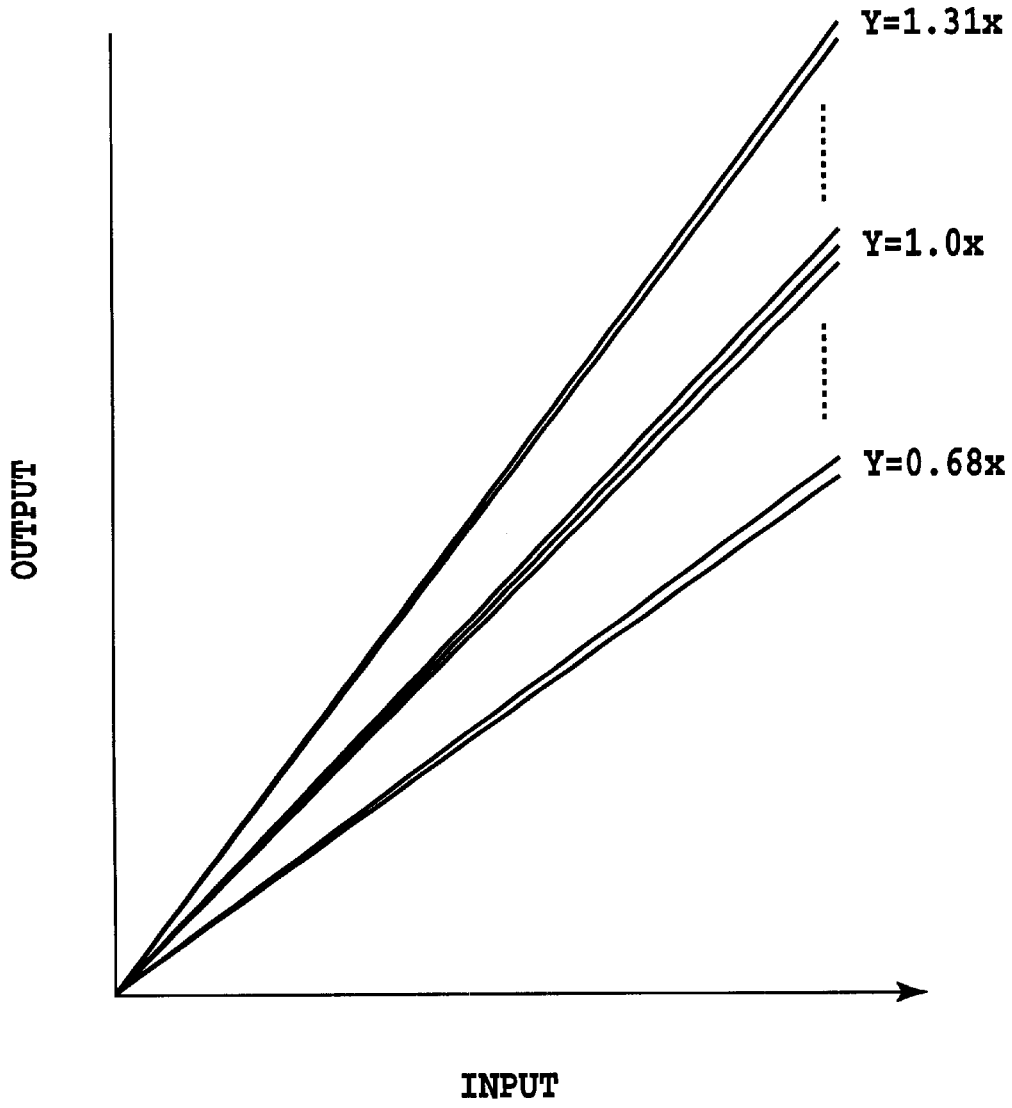
FIG. 6 is an illustration showing one example of an unevenness correction table stored in a table memory.

The reference numeral 511 denotes the HS conversion table memory storing a correction table (conversion data) consisted of 64 straight correction lines. FIG. 6 shows one example of the correction table which has 64 straight correction lines respectively having mutually distinct gradients. The HS conversion table memory 511 holds the image signal 704 for at least one reciprocal scan so that density conversion may be performed depending upon the straight correction line selected on the basis of the unevenness correcting signal 718.

Here, the density correction RAM 717 can be a component of the HDS conversion controller 510 and the HS conversion table memory 511 may be a component of ROM or RAM storing the correction table. On the other hand, when the HS conversion table memory 511 is formed with a re-writable memory, such as RAM or the like, a table stored in a separately provided ROM may be appropriately read out depending upon HS data (density unevenness correction data) arithmetic process to develop in the HS conversion table memory 511.

On the other hand, the reference numeral 720 denotes ejection recovery means for keeping the ejecting condition of the printing head h good by performing suction and so on. The reference numeral 725 denotes a head scanning means for scanning the printing head h relative to the printing medium or the printing medium for test pattern.

Next, as an concrete example the correction process of the density unevenness will be described as follows.

Figure 3:
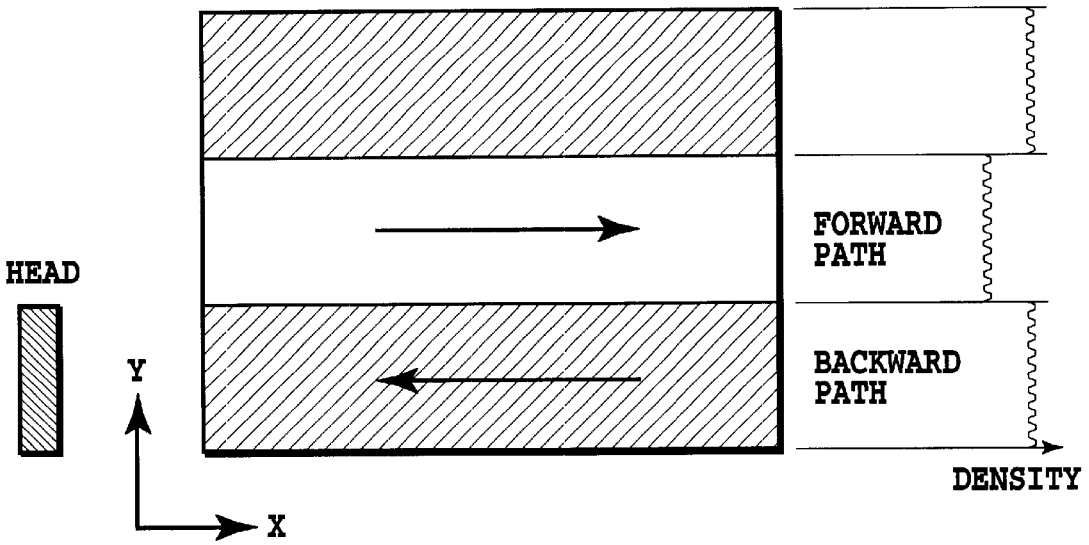
FIG. 3 is an explanatory illustration showing density variation upon performing reciprocal scan using a single head.

At first, by the density unevenness correcting portion 237 of the head characteristics measuring device 108, printing of the test image is performed. Here, as shown in FIG. 3, by using the printing head h having N in number of nozzles, respective nozzles (1 to N) are scanned reciprocally (forward and backward) to perform printing on the basis of a certain uniform image signal. Then, the printed test image is read out to measure the density distribution. At this time, the read data amount N×(forward path+backward path)=2N. The density signal 712 for 2N test image thus read is temporarily stored in RAM 219.

Then, the density signal 712 for 2N test image output from RAM 219 is fed to CPU 102A. Here, density unevenness correcting arithmetic process (averaging density, nozzle density assignment, a correcting calculation) is performed. The density unevenness correcting arithmetic process is a process for eliminating a printing density in the forward path and a printing density in the backward path.

Figure 4:
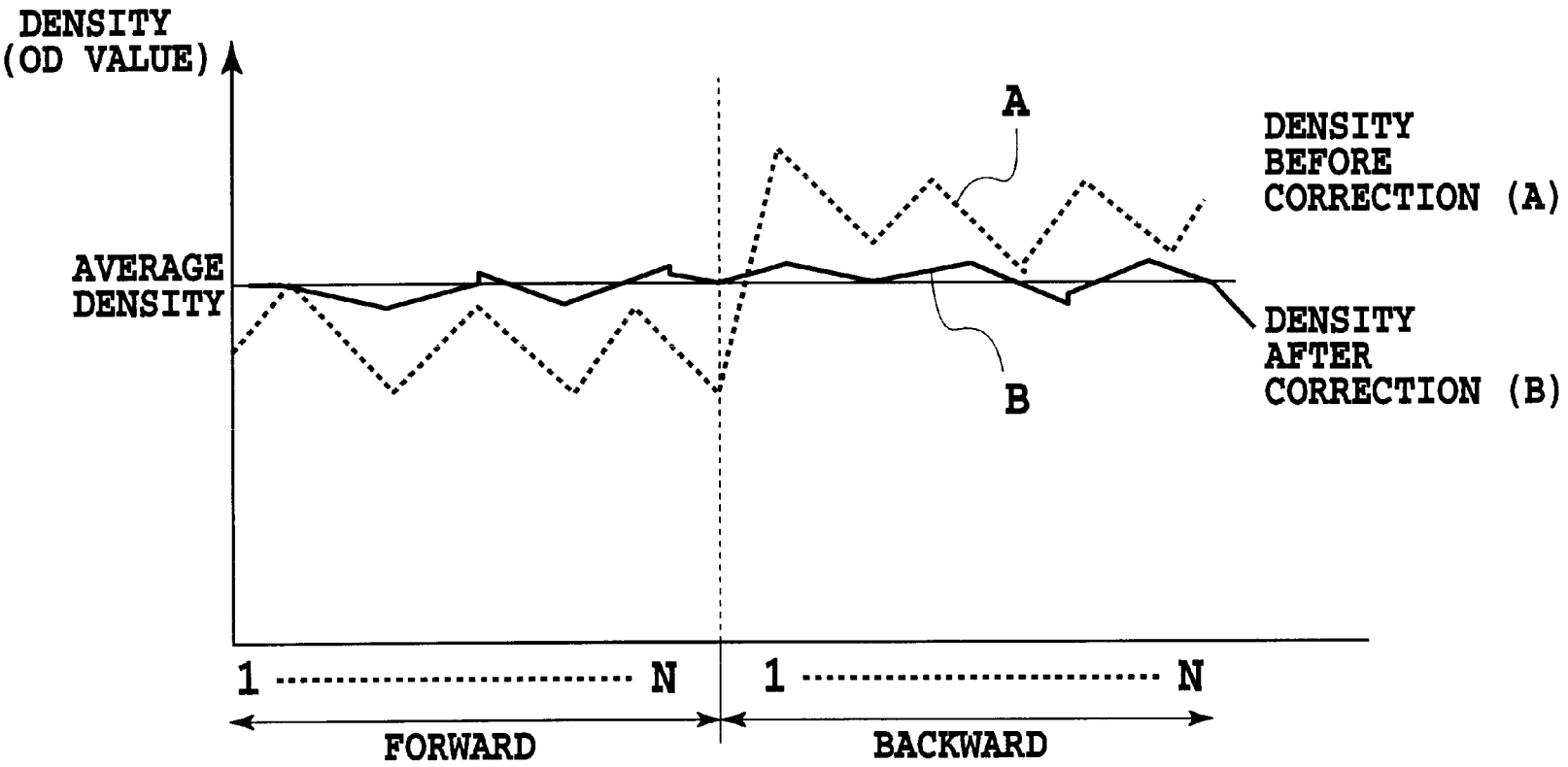
FIG. 4 is an illustration showing variation of density in the process before and after averaging of density on the basis of FIG. 3.

FIG. 4 is an illustration showing variation of density before and after performing process of density averaging. In FIG. 4, A denotes 2N in number of density signal 712 before density correction. It can be appreciated that the density in the backward path is higher than that in the forward path due to influence of satellite. Therefore, by performing process of density averaging, density unevenness caused by unevenness of density per the nozzle, can be corrected to obtain the printed image with reduced density unevenness as shown by B in FIG. 4.

Here, an average density (OD value) is calculated by the following equation (1).

$$\text{Average Density of Reciprocal Print of Correction Object (bar } OD) = \sum_{n=1}^{2N} ODn/2N \quad (1)$$

The method for calculating the average density is not specified to the method calculating per the nozzle but can be a method for deriving the average value by integrating a reflected light amount or any other known method. It should be noted that while all of forward and backward paths are processed for deriving an average as density correcting calculation, density correcting calculation is not limited to the shown way. It is also possible to perform correction calculation on the basis of density in the forward path hardly being influenced by satellite.

After thus calculation of the average density, assignment of density is performed for respective nozzles. After assignment, calculation of correction with the conversion ratio α is performed to generate the unevenness correcting signal 718 to be actually applied to the nozzles.

Here, process for generating the unevenness correcting signal 718 will be explained with reference to FIG. 6.

Figure 5A:
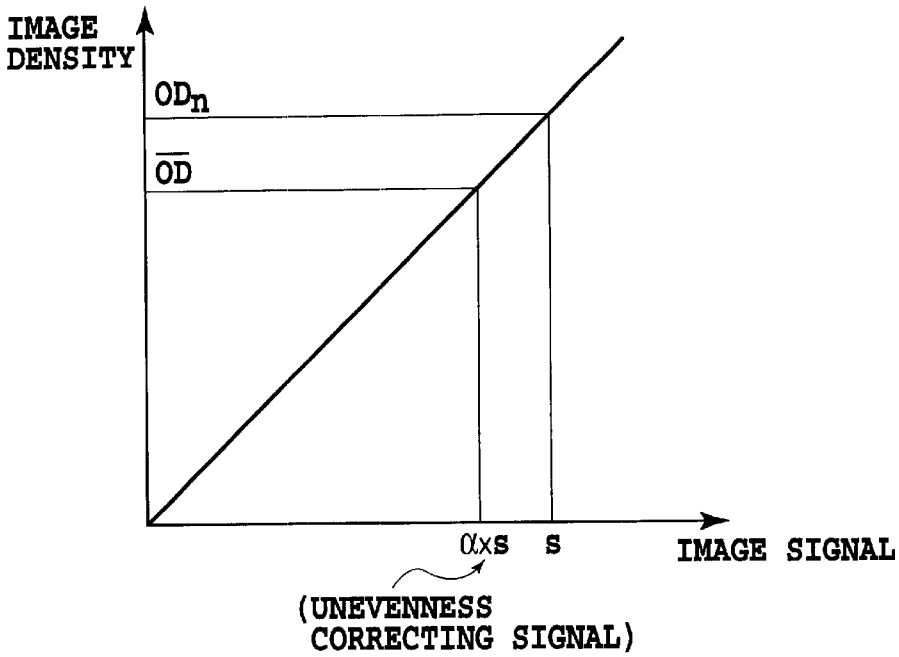
FIGS. 5A and 5B are tables illustrating an unevenness corrected signal on the basis an image density using a correction coefficient.

If a relationship between the value of the image signal S and the image density $OD_n$ of the certain nozzle or certain nozzle group is as shown in FIG. 5A, the signal to be actually applied to the nozzle or the nozzle group may be derived by determining the correction coefficient α (conversion ratio) to obtain the average density (bar OD) by correcting the image signal S. Namely, the unevenness corrected signal correcting the image signal S into $\alpha \times S = (\text{bar } OD/OD_n) \times S$ may be applied to the this element or the element group depending upon the input signal S.

Figure 5B:
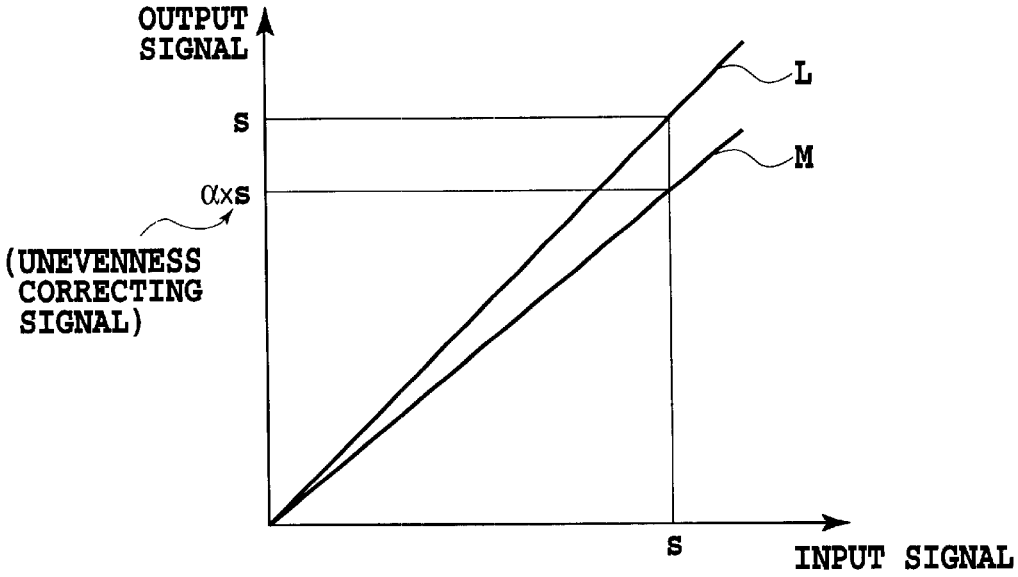

More particularly, correction can be implemented by performing table conversion for the image signal S as shown in FIG. 5B. In FIG. 5B, a straight line L is a line having a gradient of 1.0 and represents a table outputting the image signal S without any conversion. On the other hand, a straight line M is a line having a gradient of $\alpha = (\text{bar } OD/OD_n)$ and represents a table performing conversion for attaining an output signal (unevenness corrected signal) of α·S with respect to the input signal (image signal S). Accordingly, by driving the printing head h after table conversion determining the correction coefficient $\alpha_n$ for each table as illustrated by the straight line M for the image signal corresponding to the nozzle of the (n)th order, density of the portion to be printed by reciprocal print by N in number of nozzles becomes equal to the average density (bar OD). By performing such process for all of the nozzles, density unevenness can be corrected and thus uniform image can be obtained. Namely, by preliminarily deriving data what table conversion has to be performed for the image signal corresponding to which nozzle, correction of the unevenness becomes possible. Needless to say, it is also possible to perform the objective correction by an approximated unification process with density comparison of respective nozzle groups (each group is consisted of three to five nozzles).

On the other hand, while the density unevenness can be corrected by the method set forth above, it is still expected to cause density unevenness in certain use condition or environmental variation of the apparatus, or due to variation of the density unevenness per se before correction or secular change of the correction circuit. Therefore, for providing measure for further occurrence of density unevenness, the correction amount of the input signal has to be varied. As a cause of this, in case of the ink-jet printing head, it has been considered that density variation is varied due to deposition of precipitate from the ink or external foreign matter in the vicinity of the ink ejection openings during use. This can also be expected from the fact that variation of density distribution can be caused even in the thermal head due to fatigue or alternation of each heater. In such case, it becomes impossible to perform satisfactory correction of the density unevenness by the input correction amount initially set upon fabrication or the like, for example to make density unevenness perceptible in long period use. This has been a problem to be solved for permitting long time use.

The unevenness correcting signal 718 thus generated is a signal selected out of 64 kinds of 0 to 63 and is stored in the unevenness correction RAM 717 in number for reciprocal scan for respective nozzles. Then, the unevenness correcting signal 718 stored in the unevenness correction RAM 717 is output to the HS conversion table memory 511 in synchronism with input image signal.

Here, process of the HS conversion table memory 511, to which the unevenness correcting signal 718 is input will be explained.

The image signal 704 which is process by pallet conversion, is converted by each HS conversion table memory 511 for correcting unevenness of the printing head h. This unevenness correction table has 64 collection lines for switching the correction line (in the alternative, can be a non-linear curve) depending upon unevenness correcting signal 718.

FIG. 6 shows one example of the unevenness correction table. In the shown example, the unevenness correction table has 64 correction lines varying gradient per 0.01 within a range of Y=0.68X to Y=1.31X. For example, when the signal of the pixel to be printed by the nozzle having large dot diameter, is input, the correction line having small gradient is selected for correction of the image signal. Conversely, when the nozzle has small dot diameter, the correction line having large gradient is selected for correction of the image signal.

Then, by the correction line selected by the unevenness correcting signal 718, the image signal 706 corrected the unevenness is output from the HS conversion table memory 511. Subsequently, foregoing γ conversion process can be performed.

By performing unevenness correction process set forth above, ejection energy generating element corresponding to the nozzle for the portion having high density of the head is applied a decreased driving energy (e.g. driving duty). Conversely, for the ejection energy generating element corresponding to the nozzle for the portion having low density of the head is applied an increased driving energy. As a result, the density unevenness of the printing head h can be corrected to obtain uniform image. However, when the density unevenness pattern of the printing head h is varied according to use, the used unevenness correcting signal 718 is inappropriate to cause unevenness on the image. In such case, rewriting of data for unevenness correction is performed.

Figure 2:
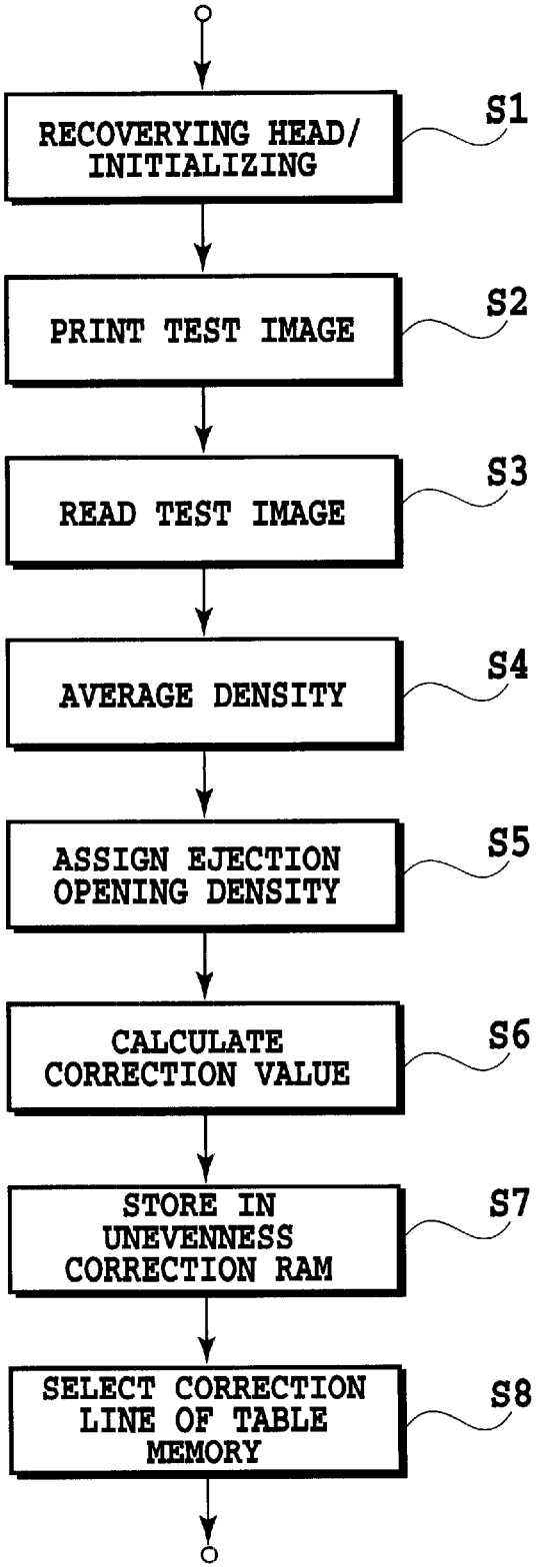
FIG. 2 is a flowchart for explaining the first embodiment of a density correction process according to the present invention.

Next, flow of the process for density correction will be explained with reference to the flowchart of FIG. 2. After performing initialization process of the printing head h (step S1), printing of test image is performed using the head characteristics measuring device 108 (step S2). Then, the printing image is read to perform density measurement (step S3).

The density signal 712 thus obtained is fed to CPU 102 to perform density unevenness correcting arithmetic process (density difference correction signal generating means). Here, respective arithmetic processes of averaging of density, assignment of nozzle density and α correction calculation are performed (steps S4 to S6). It should be noted that such arithmetic processes are stored in ROM 102B as programs.

Then, the unevenness correcting signal 718 is stored in the unevenness correction RAM 717 (step S7). This unevenness correcting signal 718 is the signal selected amount 64 kinds of 0 to 63 and present in number for reciprocation of the nozzles. Depending upon unevenness correcting signal 718, the correction line stored in the HS conversion table memory 511 is selected (step S8). By the correction line selected as set forth above, the image signal 706 having corrected density can be obtained.

Figure 7:
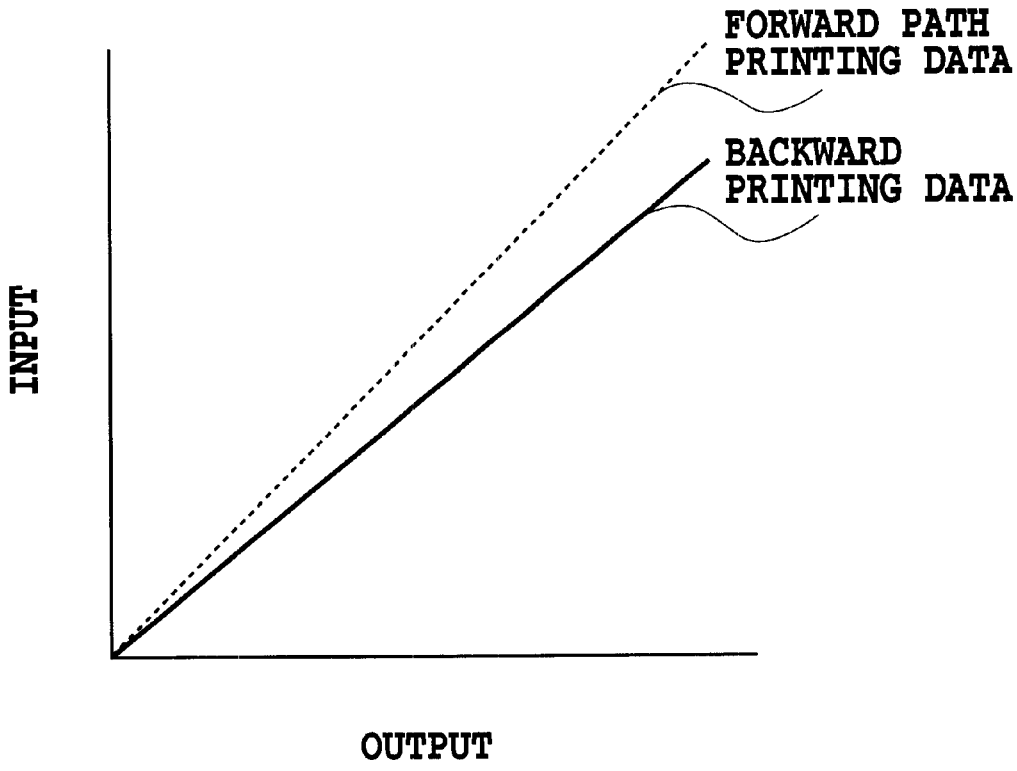
FIG. 7 is an illustration showing a relationship between input and output of a reciprocal printing data.
Figure 8:
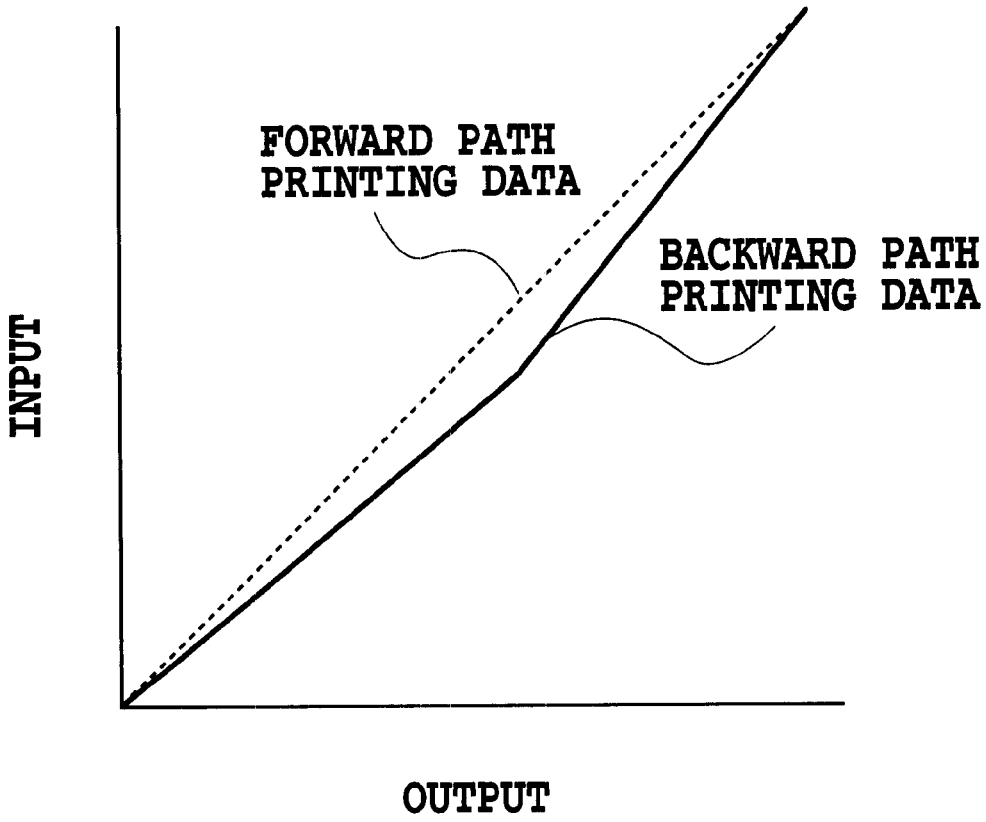
FIG. 8 is an illustration showing a modification of FIG. 7.

FIG. 7 shows an example of the case where printing is performed with reducing the density of the printing data (image signal) for the backward path in a predetermined ratio (linear) in comparison with the density of the printing data (image data) for the forward path. On the other hand, FIG. 8 shows an example of the case where the ratio to decrease the density of the printing data in the backward path is varied (non-linear). By varying amount for printing in the forward path and the backward path, namely by varying ink amount, density correction for high precision can be performed.

As a method for varying the ink amount for ejecting from each nozzle, a method for varying ink amount (number of dots) per unit area or a method for varying ink amount (ink ejection amount) per one pixel, can be considered. In the shown embodiment, as means for varying the ink amount, application of density correction coefficient (conversion ratio) α as set forth above or so on is performed.

Figure 9:
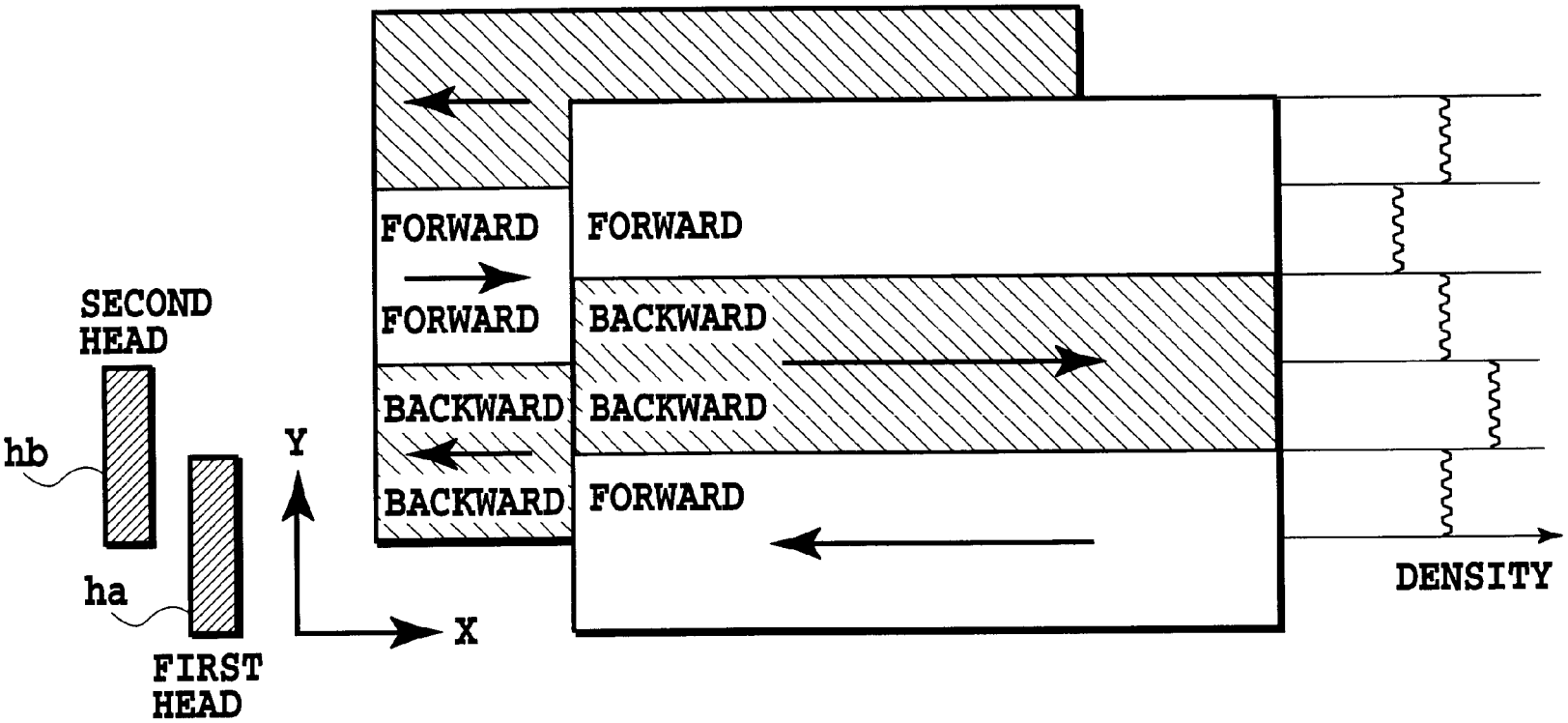
FIG. 9 is an explanatory illustration showing the second embodiment of the present invention and showing density variation upon performing reciprocal scan using two heads.

Next, the second embodiment of the present invention will be explained with reference to FIGS. 1, 9 and 10. It should be noted that like components to those of the first embodiment will be identified by like reference numerals and explanation for such common components will be neglected.

This shows an example of the case where density unevenness correction is performed by printing by reciprocal scan. Here, FIG. 9 shows an example to perform sequential multi-scan printing (interpolating printing) with offsetting two printing heads ha and hb for half band.

Combination of reciprocal printing using two printing heads ha and hb are the following four kinds.

a. $OD_1$ forward forward to $OD_k$ forward forward b. $OD_1$ forward backward to $OD_k$ forward backward c. $OD_1$ backward backward to $OD_k$ backward backward d. $OD_1$ backward forward to $OD_k$ backward forward $$k \cdot \text{forward} \cdot \text{forward} + k \cdot \text{forward backward} + k \cdot \text{backward} \cdot \text{backward} + k \cdot \text{backward} \cdot \text{forward} = 4N$$

Here, the expression "forward forward" in the item a represents forward scan by both heads. The expression "forward backward" in the item b represents that one head performs scan in forward path and the other head performs scan in backward path. The expression "backward backward" in the item a represents backward scan by both heads. The expression "backward forward" in the item b represents that one head performs scan in backward path and the other head performs scan in forward path. On the other hand, k represents number of nozzles to be actually used in the scan.

After performing reciprocal printing test in various combinations set forth above, reading of the test image is performed. The read data at this time becomes data amount for 4N. Subsequently, similar processes to those of steps S4 to S8 set forth above, namely a sequence of process of generation of the unevenness correcting signal 718, selection of the correction line and so on, are performed.

Figure 10:
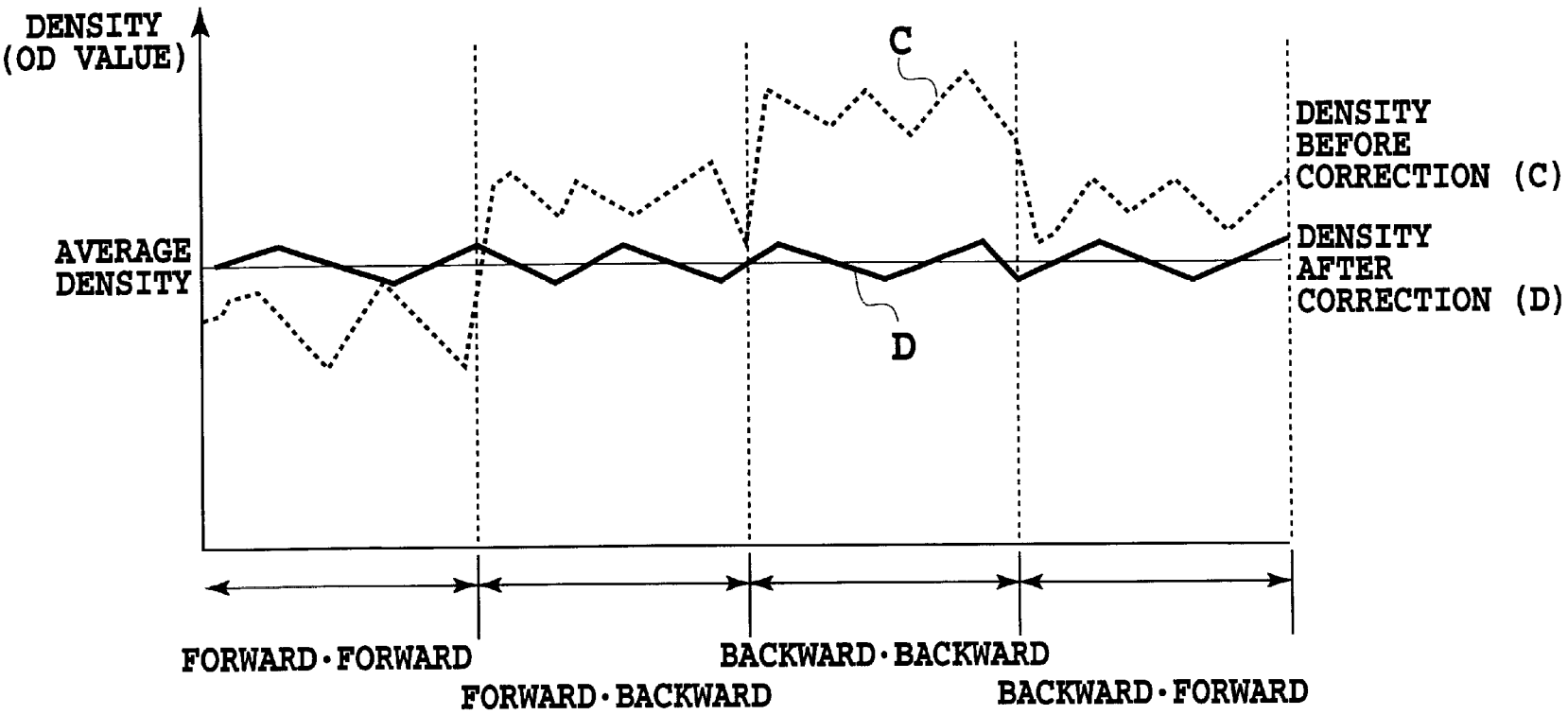
FIG. 10 is an illustration showing variation of density in the process before and after averaging of density on the basis of FIG. 9.

FIG. 10 is an illustration showing variation of density before and after the process for averaging density. In FIG. 10, C represents 4N in number of density signals 712 before density correction. By this, it can be appreciated that the level of the density in the backward path becomes significantly higher in comparison with the density of the forward path due to influence of satellite. Then, by performing correction process for averaging density, the density unevenness to be caused by unevenness of the density per nozzle can be corrected. In FIG. 10, a printing image with reduced density unevenness can be obtained as shown by D.

Then, depending upon unevenness correcting signal 718 thus generated, selection of the correction line in the HS conversion table memory 511 is performed. With respect to the image signal 704 provided pallet conversion by the correction line, the image signal 706 with corrected density in the forward path and the backward path can be obtained.

In this case, in the HS conversion table memory 511, the image signals 704 for at least four printing modes of "forward forward", "forward backward", "backward backward" and "backward forward" by combination of two heads are stored. Conversion ratios for the image signals 704 for respective printing modes are determined to perform density correction. For example, the conversion ratio of "forward backward" printing mode is set at $\alpha 1$, the conversion ratio of "backward forward" printing mode is set at $\alpha 2$, and the conversion ratio of "backward backward" printing mode is set at $\alpha 3$. The density can be reduced in the ratio of these conversion ratios. On the other hand, similarly to the first embodiment set forth above, by varying the values of the conversion ratios of $\alpha 1$, $\alpha 2$ and $\alpha 3$, high precision density correction can be performed.

In the respective examples set forth above is directed to a process to preliminarily print the test image, to optically read the result of printing and to determine conversion ratio of the density correction for the image signal depending upon the read out density data. However, the method for determining the conversion ratio for density correction is not limited to the method set forth above. For example, the density unevenness correction data depending upon desired quality (color image and so on) in relation to the printing medium, is preliminarily stored in ROM or the like to correct density difference between the forward and backward paths.

Subsequently, the description will be made of the entire processes of the ink jet cloth printing.

After the ink jet cloth printing process is executed by the use of the above-mentioned ink jet printing apparatus, the textile is dried (including the natural dry). Then, in continuation, the dyestuff on textile fabric is dispersed, and a process is executed to cause the dyestuff to be reactively fixed to the fabric. With this process, it is possible for the printed textile to obtain a sufficient coloring capability and strength because of the dyestuff fixation.

For this dispersion and reactive fixation processes, the conventionally known method can be employed. A steaming method is named, for example. Here, in this case, it may be possible to give an alkali treatment to the textile in advance before the cloth printing.

Then, in the post-treatment process, the removal of the non-reactive dyestuff and that of the substances used in the preparatory process are executed. Lastly, the defect correction, ironing finish, and other adjustment and finish processes are conducted to complete the cloth printing.

Particularly, the following performatory characteristics are required for the textile suitable for the ink jet cloth printing:

(1) Colors should come out on ink in a sufficient density.

(2) Dye fixation factor is high for ink.

(3) Ink must be dried quickly.

(4) The generation of irregular ink spread is limited.

(5) Feeding can be conducted in an excellent condition in an apparatus.

In order to satisfy these requirements, it may be possible to give a preparatory treatment to the textile used for printing as required. In this respect, the textile having an in receptacle layer is disclosed in Japanese Patent Application Laying-open No. 62-53492, for example. Also, in Japanese Patent Application Publication No. 3-46589, there are proposed the textile which contains reduction preventive agents or alkaline substances. As an example of such preparatory treatment as this, it is also possible to name a process to allow the textile to contain a substance selected from an alkaline substance, water soluble polymer, synthetic polymer, water soluble metallic salt, or urea and thiourea.

As an alkaline substance, there can be named, for example, hydroxide alkali metals such as sodium hydroxide, potassium hydroxide; mono-, di-, and tri-ethanol amine, and other amines; and carbonate or hydrogen carbonate alkali metallic salt such as sodium carbonate, potassium carbonate, and sodium hydrogen carbonate. Furthermore, there are organic acid metallic salt such as calcium carbonate, barium carbonate or ammonia and ammonia compounds. Also, there can be used the sodium trichloroacetic acid and the like which become an alkaline substance by steaming and hot air treatment. For the alkaline substance which is particularly suitable for the purpose, there are the sodium carbonate and sodium hydrogen carbonate which are used for dye coloring of the reactive dyestuffs.

As a water soluble polymer, there can be named starchy substances such as corn and wheat; cellulose substances such as carboxyl methyl cellulose, methyl cellulose, hydroxy ethyl cellulose; polysaccharide such as sodium alginic acid, gum arabic, locasweet bean gum, tragacanth gum, guar gum, and tamarind seed; protein substances such as gelatin and casein; and natural water soluble polymer such as tannin and lignin.

Also, as a synthetic polymer, there can be named, for example, polyvinyl alcoholic compounds, polyethylene oxide compounds, acrylic acid water soluble polymer, maleic anhydride water soluble polymer, and the like. Among them, polysaccharide polymer and cellulose polymer should be preferable.

As a water soluble metallic salt, there can be named the pH 4 to 10 compounds which produce typical ionic crystals, namely, halogenoid compounds of alkaline metals or alkaline earth metals, for example. As a typical example of these compounds, NaCl, $Na^2SO^4$, KCl and $CH^3$ COONa and the like can be named for the alkaline metals, for example. Also, $CaCl^2$, $MgCl^2$, and the like can be named for the alkaline earth metals. Particularly, salt such as Na, K and Ca should be preferable.

In the preparatory process, a method is not necessarily confined in order to enable the above-mentioned substances and others to be contained in the textile. Usually, however, a dipping method, padding method, coating method, spraying method, and others can be used.

Moreover, since the printing ink used for the ink jet cloth printing merely remains to adhere to the textile when printed, it is preferable to perform a subsequent reactive fixation process (dye fixation process) for the dyestuff to be fixed on the textile. A reactive fixation process such as this can be a method publicly known in the art. There can be named a steaming method, HT steaming method, and thermofixing method, for example. Also, alkaline pad steaming method, alkaline blotch steaming method, alkaline shock method, alkaline cold fixing method, and the like can be named when a textile is used without any alkaline treatment given in advance.

Further, the removal of the non-reactive dyestuff and the substances used in the preparatory process can be conducted by a rinsing method which is publicly known subsequent to the above-mentioned reactive fixation process. In this respect, it is preferable to conduct a conventional fixing treatment together when this rinsing is conducted.

In this respect, the printed textile is cut in desired sizes after the execution of the above-mentioned post process. Then, to the cut off pieces, the final process such as stitching, adhesion, and deposition is executed for the provision of the finished products. Hence, one-pieces, dresses, neckties, swimsuits, aprons, scarves, and the like, and bed covers, sofa covers, handkerchiefs, curtains, book covers, room shoes, tapestries, table clothes, and the like are obtained. As the methods of machine stitch to make clothes and other daily needs, a widely known method can be used.

As described above, according to the present invention, it is possible to obtain a high cleaning effect of the liquid discharging surface of the liquid discharging head as well as a long-time stability of the liquid discharging.

Thus, it is possible to produce the effect that the stable recovery can be executed even in a case where a highly viscous liquid is used or highly densified nozzles are employed, or further, an industrial use is required for a long time under severe conditions.

The present invention produces an excellent effect on an ink jet printing head and printing apparatus, particularly on those employing a method for utilizing thermal energy to form flying in droplets for the printing.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type printing system and a continuous type printing system. Particularly, however, it is suitable of the on-demand type because the principle is such that at least one driving signal, which provides a rapid temperature rise beyond a departure from nucleation boiling point in response to printing information, is applied to an electrothermal transducer disposed on a liquid (ink) retaining sheet or liquid passage whereby to cause the electrothermal transducer to generate thermal energy to produce film boiling on the thermoactive portion of the printing head; thus effectively leading to the resultant formation of a bubble in the printing liquid (ink) one to one for reach of the driving signals. By the development and contraction of the bubble, the liquid (ink) is discharged through a discharging port to produce at least one droplet. The driving signal is preferably in the form of pulses because the development and contraction of the bubble can be effectuated instantaneously, and, therefore, the liquid (ink) is discharged with quicker responses.

The driving signal in the form of pulses is preferably such as disclosed in the specifications of U.S. Pat. Nos. 4,463,359 and 4,345,262. In this respect, if the conditions disclosed in the specification of U.S. Pat. No. 4,313,124 regarding the rate of temperature increase of the heating surface is preferably are adopted, it is possible to perform an excellent printing in a better condition.

The structure of the printing head may be as shown in each of the above-mentioned specifications wherein the structure is arranged to combine the discharging ports, liquid passages, and electrothermal transducers as disclosed in the above-mentioned patents (linear type liquid passage or right angle liquid passage). Besides, it may be possible to form a structure such as disclosed in the specifications of U.S. Pat. Nos. 4,558,333 and 4,459,600 wherein the thermally activated portions are arranged in a curved area.

Furthermore, as a full line type printing head having a length corresponding to the maximum printing width, the present invention demonstrates the above-mentioned effect more efficiently with a structure arranged either by combining plural printing heads disclosed in the above-mentioned specifications or by a single printing head integrally constructed to cover such a length.

In addition, the present invention is effectively applicable to a replaceable chip type printing head which is connected electrically with the main apparatus and can be supplied with ink when it is mounted in the main assemble, or to a cartridge type printing head having an integral ink container.

Furthermore, as a printing mode for the printing apparatus, it is not only possible to arrange a monochromatic mode mainly with black, but also it may be possible to arrange an apparatus having at least one of multi-color mode with different color ink materials and/or a full-color mode using the mixture of the colors irrespective of the printing heads which are integrally formed as one unit or as a combination of plural printing heads. The present invention is extremely effective for such an apparatus as this.

Now, in the embodiments according to the present invention set forth above, while the ink has been described as liquid, it may be an ink material which is solidified below the room temperature but liquefied at the room temperature or may be liquid. Since the ink is controlled within the temperature not lower than 30° C. and not higher than 70° C. to stabilize its viscosity for the provision of the stable discharge in general, the ink may be such that it can be liquefied when the applicable printing signals are given.

In addition, while preventing the temperature rise due to the thermal energy by the positive use of such energy as an energy consumed for changing states of the ink from solid to liquid, or using the ink which will be solidified when left intact for the purpose of preventing ink evaporation, it may be possible to apply to the present invention the use of an ink having a nature of being liquefied only by the application of thermal energy such as an ink capable of being discharged as ink liquid by enabling itself to be liquefied anyway when the thermal energy is given in accordance with printing signals, an ink which will have already begun solidifying itself by the time it reaches a printing medium.

In addition, as modes of a printing apparatus according to the present invention, there are a copying apparatus combined with reader and the like, and those adopting a mode as a facsimile apparatus having transmitting and receiving functions, besides those used as an image output terminal structured integrally or individually for an information processing apparatus such as a word processor and a computer.

As set forth above, according to the embodiments of the present invention, density difference correction signal for correcting density difference between forward path printing and reverse path printing is generated to perform density correction of the image data for forward path printing and reverse path printing. Thus, printing density can be controlled in the forward path and the reverse path. By this, difference of the printing density of the forward path and the reverse path due to satellite can be removed to enable high precision and high quality image printing.

On the other hand, according to the embodiments of the present invention, even when sequential multi-scan is performed using a plurality of head, conversion ratio of density correction of the image data per printing mode by scanning of combination of the heads can be determined to enable high quality image printing with avoiding influence of satellite.

Furthermore, according to the embodiment of the present invention, optimal density correction can also be performed even by preliminarily printing the test data and reading the test data, and determining the value of the conversion ratio of density correction depending upon the density data.

What is claimed is:

1. In an image printing apparatus having scanning means for scanning at least one printing head for ejecting an ink in reciprocal scanning including a forward path and a backward path, and printing control means for ejecting said ink by driving said at least one printing head and printing an image on a printing medium during said reciprocal scanning by said scanning means, the image printing apparatus comprising:

density difference correction signal generating means for generating a density difference correction signal for correcting a density difference between an image density upon forward path printing by said at least one printing head and an image density upon backward path printing by said printing head;

storage means for storing the generated density difference correction signal; and density conversion means for varying image density of image data for forward printing and backward printing depending upon the stored density difference correction signal.

2. An image printing apparatus as claimed in claim 1, wherein said density conversion means holds at least one pair of image data of the forward path and the backward path scanning to correct the image data for forward path scanning and the image data for backward path scanning.

3. An image printing apparatus as claimed in claim 1, wherein said density difference correction signal generating means comprises: means for performing an averaging process of the image density; assigning means for assigning said averaged image density to each ejection openings forming said printing head; and means for generating said density difference correction signal by providing density correction coefficient for each assigned image density.

4. An image printing apparatus as claimed in claim 1, wherein said printing head is an ink-jet head ejecting an ink and performs printing by ejecting the ink toward said printing medium from said ink-jet head.

5. An image printing method as claimed in claim 4, wherein said ink-jet head generates bubble in the ink to eject the ink associating with generation of the bubble.

6. An image printing apparatus as claimed in claim 1, wherein said ink-jet head generates bubble in the ink to eject the ink associating with generation of the bubble.

7. An image printing apparatus reciprocating a plurality of printing heads and performing overlay printing of an image for a printing medium by the combined scans of forward path and backward path of a plurality of said printing heads, comprising:

density difference correction signal generating means for generating a density difference correction signal for correcting a density difference by the combined scans of forward path and backward path of a plurality of said printing heads;

storage means for storing the generated density difference correction signal; and density conversion means for varying image density of image data upon printing by the combined scans of the forward path and the backward path depending upon the stored density difference correction signal.

8. In an image printing apparatus having scanning means for scanning at least one printing head for ejecting an ink in reciprocal scanning including a forward path and a backward path, and printing control means for ejecting said ink by driving said at least one printing head and printing an image on a printing medium during said reciprocal scanning by said scanning means, the image printing apparatus comprising:

printing means for printing test images in a forward path scan and backward path scan of said printing head;

reading means for reading the printed test images;

density difference correction signal generating means for generating a density difference correction signal for correcting a density difference between the test image density upon forward path printing by said at least one printing head and the test image density upon backward path printing by said at least one printing head;

storage means for storing the generated density difference correction signal; and density conversion means for varying image density of image data for forward printing and backward printing depending upon the stored density difference correction signal.

9. An image printing apparatus as claimed in claim 8, wherein said density conversion means holds at least one pair of image data of the forward path and the backward path scanning to correct the image data for forward path scanning and the image data for backward path scanning.

10. An image printing apparatus as claimed in claim 8, wherein said density difference correction signal generating means comprises: means for performing an averaging process of the image density; assigning means for assigning said averaged image density to each ejection openings forming said printing head; and means for generating said density difference correction signal by providing density correction coefficient for each assigned image density.

11. An image printing apparatus as claimed in claim 8, wherein said printing head is an ink-jet head ejecting an ink and performs printing by ejecting the ink toward said printing medium from said ink-jet head.

12. An image printing, apparatus as claimed in claim 8, wherein said at least one printing head generates a bubble in the ink to eject the ink associated with generation of the bubble.

13. An image printing apparatus reciprocating a plurality of printing heads and performing overlay printing of an image for a printing medium by the combined scans of forward path and backward path of a plurality of said printing heads, comprising:

printing means for printing test images by the combined scans of forward path and backward path scan of said printing heads;

reading means for reading the printed test images;

density difference correction signal generating means for generating a density difference correction signal for correcting a density difference of the test images formed by the combined scans of forward path and backward path of a plurality of said printing heads;

storage means for storing the generated density difference correction signal; and density conversion means for varying image density of image data upon printing by the combined scans of the forward path and the backward path depending upon the stored density difference correction signal.

14. An image printing apparatus as claimed in claim 7, or 13, wherein said density conversion means holds at least each one unit of image data as a series of printing unit of each combination of said forward path and said backward path, and corrects the image data per the printing unit.

15. In an image printing method having a scanning step for scanning at least one printing head for ejecting an ink in reciprocal scanning including a forward path and a backward path, and a printing control step for ejecting said ink by driving said at least one printing head and printing an image on a printing medium during said reciprocal scanning by said scanning step, the image printing method comprising the steps of:

generating a density difference correction signal for correcting a density difference between an image density upon forward path printing by said at least one printing head and an image density upon backward path printing by said at least one printing head; and varying image density of image data for forward printing and backward printing depending upon generated density difference correction signal.

16. An image printing method as claimed in claim 15, wherein said printing head is an ink-jet head ejecting an ink and performs printing by ejecting the ink toward said printing medium from said ink-jet head.

17. An image printing method as claimed in claim 15, wherein the method includes the step of:

performing an averaging process of the image density;

assigning said averaged image density to each ejection opening forming said printing head; and generating a density difference correction signal by providing density correction coefficient for each assigned image density.

18. An image printing method reciprocating a plurality of printing heads and performing overlay printing of an image for a printing medium by the combined scans of forward path and backward path of a plurality of said printing heads, comprising the steps of:

generating a density difference correction signal for correcting a density difference by the combined scans of forward path and backward path of a plurality of said printing heads; and varying image density of image data upon printing by the combined scans of the forward path and the backward path depending upon the generated density difference correction signal.

19. An image printing method having a scanning step for scanning at least one printing head for ejecting an ink in reciprocal scanning including a forward path and a backward path, and a printing control step for ejecting said ink by driving said at least one printing head and printing an image on a printing medium during said reciprocal scanning by said scanning step, the image printing method comprising the steps of:

printing test images in forward path scan and backward path scan of said at least one printing head;

reading the printed test images;

generating a density difference correction signal for correcting a density difference between the test image density upon forward path printing by said at least one printing head and the test image density upon backward path printing by said at least one printing head; and varying image density of image data for forward printing and backward printing depending upon generated density difference correction signal.

20. An image printing method as claimed in claim 19, wherein said printing head is an ink-jet head ejecting an ink and performs printing by ejecting the ink toward said printing medium from said ink-jet head.

21. An image printing method as claimed in claim 19, wherein said ink-jet head generates bubble in the ink to eject the ink associating with generation of the bubble.

22. An image printing apparatus reciprocating a plurality of printing heads and performing overlay printing of an image for a printing medium by the combined scans of forward path and backward path of a plurality of said printing heads, comprising the steps of:

printing test images by the combined scans of forward path and backward path scan of said printing heads;

reading the printed test images;

generating a density difference correction signal for correcting a density difference of the test images formed by the combined scans of forward path and backward path of a plurality of said printing heads; and varying image density of image data upon printing by the combined scans of the forward path and the backward path depending upon the generated density difference correction signal.

* * * * *

UNITED STATES PATENT AND TRADEMARK OFFICE

CERTIFICATE OF CORRECTION

PATENT NO. : 6,435,643 B1
DATED : August 20, 2002
INVENTOR(S) : Yasushi Miura et al.

It is certified that error appears in the above-identified patent and that said Letters Patent is hereby corrected as shown below:

Column 4,
Line 32, “performing” should be deleted.

Column 23,
Line 35, “method” should read -- apparatus --.

Column 24,
Line 31, “printing,” should read -- printing --.

Column 26,
Line 21, “apparatus” should read -- method --.

Signed and Sealed this

Seventeenth Day of February, 2004

JON W. DUDAS
*Acting Director of the United States Patent and Trademark Office*